US006140775A

United States Patent [19]

Hirakawa

[11] Patent Number: 6,140,775

[45] Date of Patent: Oct. 31, 2000

[54] METHOD FOR DRIVING AC DISCHARGE MEMORY-TYPE PLASMA DISPLAY PANEL

[75] Inventor: Shinji Hirakawa, Tokyo, Japan

[73] Assignee: NEC Corporation, Tokyo, Japan

[21] Appl. No.: 09/420,367

[22] Filed: Oct. 18, 1999

[30] Foreign Application Priority Data

Oct. 16, 1998 [JP] Japan ..... 10-295671

[51] Int. Cl.[7] ..... G09G 3/10

[52] U.S. Cl. ..... 315/169.4; 315/169.1; 345/68; 345/204; 345/208

[58] Field of Search ..... 315/169.4, 169.1, 315/169.2; 345/41, 60, 67, 68, 204, 208–210

[56] References Cited

U.S. PATENT DOCUMENTS

| | | | |
|---|---|---|---|
| 5,663,741 | 9/1997 | Kanazawa | 315/169.4 X |
| 5,684,499 | 11/1997 | Shimizu et al. | 315/169.4 X |
| 5,790,087 | 8/1998 | Shigeta et al. | 345/67 |
| 5,874,932 | 2/1999 | Nagaoka et al. | 345/60 |
| 5,936,355 | 8/1999 | Kim | 315/169.4 |
| 5,963,184 | 10/1999 | Tokunaga et al. | 315/169.4 X |
| 5,982,344 | 11/1999 | Tokunaga | 345/67 |
| 6,037,916 | 3/2000 | Amemiya | 315/169.4 X |
| 6,066,923 | 5/2000 | Noborio et al. | 315/169.4 |

FOREIGN PATENT DOCUMENTS 10-274955 10/1998 Japan .

*Primary Examiner*—Haissa Philogene
*Attorney, Agent, or Firm*—Hutchins, Wheeler & Dittmar

[57] ABSTRACT

Methods for driving an AC discharge memory-type plasma display panel having a scanning electrode, a sustaining electrode and a data electrode, in which a driving pulse can be applied so that temporal separation of opposing discharge from surface discharge in erasing discharge during a sustaining charge erasing period is achieved to solve problems that, if opposing discharge and surface discharge occur simultaneously during the sustaining erasing discharge, control on electric charges is difficult in operations containing, at least, a writing period and a sustaining period, causing a malfunction during the writing and sustaining periods.

17 Claims, 13 Drawing Sheets

METHOD FOR DRIVING AC DISCHARGE MEMORY-TYPE PLASMA DISPLAY PANEL

BACKGROUND OF THE INVENTION

1. Field of the Invention

The present invention relates to method for driving a plasma display panel and more particularly to method of driving an AC discharge memory-type plasma display panel in which sustaining charge erasing operations are incorporated.

2. Description of the Related Art

In general, a plasma display panel (hereinafter referred to as PDP) is featured by thin construction, no flicker on the display and a great display contrast ratio. Moreover, it has various features including a large screen, high response speed, spontaneous light emission as well as multi-color emission. Owing to these characteristics, the plasma display panel is widely used for display devices and color imaging displays in the field of computers and related equipment.

The PDP can be classified into two types, one being of an ac discharge type adapted to operate in the ac discharge state using an electrode coated with dielectrics, the other being of a DC (Direct Current) discharge type adapted to operate in the DC discharge state with an electrode exposed to discharge gas space. The ac discharge type PDP can be further sub-classified into two types, one being of a memory-type utilizing a driving method using memory functions of a discharge cell and the other being of a refresh type not using such memory functions of the discharge cell. Luminance of the PDP is proportional to the number of discharging operations, i.e., the number of repetition of the pulse voltage. In the case of the above refresh type PDP, if display capacity becomes large, luminance is reduced and therefore it is mainly used in the PDP with small display capacity.

FIG. 11 is a cross-sectional diagram illustrating configurations of one display cell 16 of an AC discharge memory-type PDP. This display cell 16 is comprised of a front insulating board 1 and a rear insulating board 2 both of which are made of glass, trace electrodes 5 and 6 adapted to lie on a scanning electrode 3 and a sustaining electrode 4 in order to lower resistance of the electrode, a data electrode 7 formed, on the rear insulating board 2, so that it may intersect at right angles with the scanning electrode 3 and the sustaining electrode 4, discharge gas space 8 filled with discharge gas including helium, neon, xenon or their mixed gas disposed in space between the front insulating board 1 and the rear insulating board 2, a phosphor 11 used to convert ultra violet rays generated by discharge of the discharge gas to visible light 10, a dielectric layer 12 used to coat the scanning electrode 3 and the sustaining electrode 4 therewith, a protecting layer 13 composed of magnesium oxide or the like to protect the dielectric layer against discharging and a dielectric layer 14 used to coat the data electrode therewith.

Next, operations of discharge of a selected display cell 16 are hereafter described by referring to FIG. 11. If discharge is allowed to occur by applying a pulse voltage exceeding discharge threshold values between the scanning electrode 3 and the data electrode 7, positive and negative charges are attracted to surfaces of dielectric layers disposed on both sides in response to polarity of the pulse voltage, causing charges to be accumulated.

Since the equivalent voltage caused by accumulation of electric charges, i.e., wall voltages are of the opposite polarity, an effective voltage within the cell is lowered as the discharge grows and, even if the above pulse voltage is maintained at a definite value, the discharge cannot be maintained and stops in the end.

After that, if a sustaining discharge pulse being a pulse voltage of the same polarity as a wall voltage is applied between the scanning electrode 3 and the sustaining electrode 4 being adjacent to each other, since wall charges are superposed on as the effective voltage, even if the amplitude of the voltage of the sustaining discharge pulse is low, the discharge is possible at a voltage exceeding the discharge threshold. Therefore, the discharge can be maintained by alternately applying a sustaining discharge pulse between the scanning electrode 3 and the sustaining electrode 4. This function is a memory function described above.

The above sustaining discharge can be stopped by applying, to the scanning electrode 3 or the sustaining electrode 4, an erasing pulse having wide pulse width and a low voltage or an erasing pulse having a mild fall (or a rise), a wide width and almost the same voltage as that of the sustaining pulse that can be used to neutralize wall charges or an erasing pulse having narrow width and the almost the same voltage as that of the sustaining pulse or a pulse combined with these pulses.

FIG. 12 is a top plan view of approximate configurations of the PDP composed of display cells 16 disposed in a matrix state shown in FIG. 11. The PDP 15 is a panel used for dot matrix display in which "m×n" pieces of lines and rows are arranged. The scanning electrodes Ss1, Ss2, . . . Ssm and the sustaining electrode Su disposed in parallel with each other are arranged as line electrodes. The data electrodes D1, D2, . . . Dn disposed so as to intersect, at right angles, with the scanning and sustaining electrodes as row electrodes.

In FIG. 13, Wu represents a sustaining electrode driving pulse supplied to a sustaining electrode Su, Ws1, Ws2, . . . Wsm are driving pulses supplied to each of scanning electrodes Ss1, Ss2, . . . Ssm, and Wd is a data electrode driving pulse supplied to a data electrode Di ($1 \leqq i \leqq n$). One cycle (one frame) of driving contains a pre-discharged period, a writing period, a sustaining discharge period and a sustaining charge erasing period and a desired image can be obtained by repeating this cycle of driving.

The pre-discharge period is a period to generate active particles and wall charges in the discharge gas space in order to obtain stable writing discharge characteristics during the writing period. In the operations, all the pre-discharge pulses Pp+ and Pp− are applied and then further the pre-discharge erasing pulse Ppe used to discharge all display cells 16 of the PDP 15 is applied to all the scanning electrodes in order to erase electric charges, out of wall charges generated during the pre-discharge period, to interfere with the writing discharge and sustaining discharge. That is, the pre-discharge pulse of the positive polarity Pp+ is applied to the scanning electrodes Ss1, Ss2, . . . Ssm, the pre-discharge pulse of the negative Pp− is applied to the sustaining electrode Su and, after discharge has occurred on all display cells 16, an erasing pulse Ppe is applied to scanning electrodes Ss1, Ss2, . . . Ssm to cause erasing discharge to occur to erase wall charges accumulated by the pre-discharge pulses.

During the writing period, a scanning pulse Pw is sequentially applied to each of scanning electrodes Ss1, Ss2, . . . Ssm while a data pulse Pd is selectively applied, in synchronization with the scanning pulse Pw, to the data electrode Di ($1 \leqq i \leqq n$) of a display cell 16 in which a display is performed and writing discharge is allowed to occur in the cell to be used for displaying to generate wall charges.

During the sustaining discharge period, a sustaining discharge pulse of the negative polarity Psu is applied to the sustaining electrode while a sustaining discharge pulse of the negative Pss that lags 180 degrees behind the sustaining discharge pulse Psu is applied to each scanning electrode and, during the writing discharge period, necessary sustaining discharge is maintained in order to obtain desired luminance in the cell in which the writing discharge is performed.

During the sustaining charge erasing period, the sustaining discharge is erased by applying erasing pulses Pse1 and Pse2 that have narrow width and have a voltage being as low as that of the sustaining discharge pulse and pulses combined with erasing pulses Pse3 having a mild fall and a wide width and a voltage as low as that of the sustaining discharge pulse.

Conventional operations during the latter half of the sustaining discharge period and the sustaining charge erasing period disclosed in Japanese Laid-Open Patent Application No. Hei10-274955 are described hereinafter to get a clear understanding of the present invention and to show shortcomings of the conventional technologies. FIG. 14 is an expanded diagram showing waveforms appeared during the latter half of the sustaining discharge period and during the sustaining charge erasing period in an embodiment disclosed in Japanese Laid-Open Patent Application No. Hei10-274955.

Immediately before the application of a final sustaining pulse of the positive polarity Psse, negative charges produced by sustaining pulses of the negative polarity Pss and Psu are accumulated, and positive and negative charges are accumulated on a scanning electrode and on a sustaining electrode respectively.

Since negative charges on a data electrode is adapted to act so as to counteract a voltage applied at the time of writing discharge, the final sustaining pulse of the positive polarity Psse applied at a last point of the sustaining discharge period is applied in order to erase negative charges on the data electrode as well as to generate sustaining discharge.

The sustaining charge erasing period is a period to erase wall charges accumulated on each electrode during the sustaining discharge period. Wall charges on the scanning electrode and sustaining electrode are erased by pulses Pse1, Pse2 and Pse3. Wall charges on the data electrode are erased by a final sustaining pulse of the positive polarity. It is necessary that wall charges on each electrode do not exist after the sustaining charge erasing period and that the discharging cell is electrically neutral.

When the final sustaining pulse of the positive polarity is applied, since the positive charge on the scanning electrode is superposed on the negative charge on the data electrode, an effective voltage in the discharge gas space exceeds an opposing discharge starting voltage, and further due to superposition of negative charges on the sustaining electrode, the effective voltage exceeds a surface discharge starting voltage. The opposing discharge refers to discharge occurred between the scanning and data electrodes, or between the sustaining and data electrodes. Therefore, by the application of the pulse Psse, both the surface discharge and the opposing discharge occur at the same time.

As depicted in FIG. 11, a phosphor is provided in a layer adjacent to the gas discharge space 8 on the data electrode 7 and a protecting layer is provided in a layer adjacent to a gas discharge space 8 on the scanning electrode 3 and the sustaining electrode 4. A substance having a large secondary emission coefficient such as magnesium oxide or the like is used as a material for the protecting layer 13. Accordingly, in the case of discharge where the scanning electrode or the sustaining electrode is used as a cathode, since the secondary emission of the cathode is large and the discharge starting voltage is low, the growth of the discharge is rapid. On the other hand, in the case of discharge where the data electrode is used as a cathode, the secondary emission is small and the discharge starting voltage is high.

If the surface discharge and the opposing discharge in which the data electrode is used as a cathode occur by the application of the pulse Psse, the opposing discharge that cannot grow solely to be strong grows and becomes strong due to active particles generated by the surface discharge in the discharge gas space. By the effect of the strong opposing discharge, the surface discharge becomes much stronger. That is, if the opposing discharge by the final sustaining pulse of the positive polarity and the surface discharge occur at the same time, both of them interacts with each other.

Accordingly, if the surface discharge and the opposing discharge occur at the same time, since the surface discharge is the sustaining discharge, the discharge state varies depending on the amount of display load which exerts an influence on the opposing discharge and, as a result, negative charges on the data electrode cannot be erased and, reversely, excessive positive charge is accumulated, causing the data electrode not to be electrically neutral. If many residual negative charges stay on the data electrode, the internal voltage counteracts an external voltage at the time of the writing discharge, the effective voltage in the discharge gas space is lowered and the writing discharge of a selected cell does not occur. If many residual positive charges still stay on the data electrode, the internal voltage is superposed on the external voltage generated by the scanning pulse or sustaining pulse of the negative polarity, causing discharge to occur in a non-selected cell.

Thus, in the conventional technology as disclosed in Japanese Laid-Open Patent Application No. Hei10-274955, if the opposing and surface discharges by the final sustaining pulse of the positive polarity occur at the same time, control on charges on the data electrode becomes difficult, presenting a problem in that a malfunction during the writing period and sustaining period occurs.

SUMMARY OF THE INVENTION

In view of the above, it is an object of the present invention to provide a method for driving an AC discharge memory-type plasma display panel in which a driving pulse can be applied so that temporal separation of an opposing discharge from a surface discharge in erasing discharge during sustaining charge erasing period is achieved.

According to a first aspect of the present invention, there is provided a method for driving an AC discharge memory-type plasma display panel having a scanning electrode, a sustaining electrode and a data electrode comprising a step of applying a driving pulse to achieve temporal separation of opposing discharge from surface discharge in erasing discharge during a sustaining charge erasing period in driving method containing, at least, a writing period, a sustaining discharge period and a sustaining charge erasing period.

In the foregoing, a preferable mode is one that wherein comprises steps of, during a sustaining charge period, applying a sustaining charge erasing pulse to a scanning electrode and applying a bias pulse having a leading edge synchronized to that of the sustaining charge erasing pulse and the same polarity as that of the sustaining charge erasing pulse and pulse width being shorter than that of the sustaining charge erasing pulse to the sustaining electrode to cause opposing discharge to occur as erasing discharge between the scanning electrode and the data electrode in response to a leading edge of the bias pulse and to cause surface discharge to occur as erasing discharge in response to a trailing edge of the bias pulse.

Also, a preferable mode is one wherein pulse width of the bias pulse is shorter 0.5 to 2 microseconds than that of the sustaining charge erasing pulse.

Also, a preferable mode is one that wherein comprises steps of, during a sustaining charge erasing period, applying a first sustaining charge erasing pulse to the scanning electrode and applying a bias pulse having a leading edge synchronized to that of the first sustaining charge erasing pulse, the same polarity and pulse width as those of the first sustaining charge erasing pulse to the sustaining electrode to cause opposing discharge to occur as erasing discharge between the scanning electrode and the data electrode, and applying a second sustaining charge erasing pulse having the same polarity as that of the first sustaining charge erasing pulse only to the scanning electrode to cause surface discharge to occur as erasing discharge between the scanning electrode and the sustaining electrode.

Also, a preferable mode is one wherein pulse width of said second sustaining charge erasing pulse is 0.5 to 2 microseconds.

Also, a preferable mode is one that wherein comprises steps of, during a sustaining charge erasing period, applying a first sustaining charge erasing pulse to the scanning electrode and applying a bias pulse having a leading edge synchronized to that of the first sustaining charge erasing pulse and the same polarity and pulse width as those of the first sustaining charge erasing pulse to the sustaining electrode to cause opposing discharge to occur as erasing discharge between the scanning electrode and data electrode, and then applying a second sustaining charge discharge having polarity being opposite to the bias pulse only to said sustaining electrode to cause surface discharge to occur as erasing discharge between the scanning electrode and sustaining electrode.

Also, a preferable mode is one that wherein pulse width of the second sustaining charge erasing pulse is 0.5 to 2 microseconds.

Also, a preferable mode is one that wherein comprises steps of, during a sustaining charge erasing period, applying a sustaining charge erasing pulse comprised of a front-step pulse of a first voltage and a rear-step pulse of the second voltage being higher than that of the front-step pulse to the scanning electrode and applying a data bias pulse having a leading edge synchronized to that of the sustaining charge erasing pulse, polarity being opposite to that of the sustaining charge erasing pulse and the same pulse width as that of the front-step pulse to said data electrode to cause opposing discharge to occur as erasing discharge between the scanning electrode and the data electrode in response to the front-step portion of the sustaining charge erasing pulse and the data bias pulse and to cause surface discharge to occur as erasing discharge between the scanning electrode and the sustaining electrode in response to the rear-step portion of the sustaining charge erasing pulse.

Also, a preferable mode is one wherein pulse width of the rear-step pulse is 0.5 to 2 microseconds.

Also, a preferable mode is one that wherein comprises steps of, during a sustaining charge erasing period, applying a sustaining charge erasing pulse to the scanning electrode, applying a bias pulse having a leading edge synchronized to that of the sustaining charge erasing pulse, the same pulse as that of the sustaining charge erasing pulse and pulse width being shorter than that of the sustaining charge erasing pulse to the sustaining electrode to cause opposing discharge to occur as erasing discharge between the scanning electrode and data electrode, and then applying a data bias pulse having a leading edge rising earlier than a trailing edge of the bias pulse, a trailing edge synchronized to that of the sustaining charge erasing pulse and the same polarity as that of the sustaining charge erasing pulse to the data electrode to cause surface discharge to occur as erasing discharge between the scanning electrode and the sustaining electrode in response to the trailing edge of the bias pulse.

Also, a preferable mode is one wherein a leading edge of said data bias pulse is 0.5 to 2 microseconds slower than that of said sustaining charge erasing pulse.

Also, a preferable mode is one that wherein comprises steps of, during a sustaining charge erasing period, applying a sustaining charge erasing pulse to the scanning electrode, applying a bias pulse having a leading edge synchronized to that of the sustaining charge erasing pulse, the same polarity as that of the sustaining charge erasing pulse and pulse width being shorter than that of the sustaining charge erasing pulse to the sustaining electrode, and then applying a data bias pulse having a leading edge synchronized to that of the sustaining charge erasing pulse, the same polarity as that of the sustaining charge erasing pulse and pulse width being longer than that of said sustaining charge erasing pulse to the data electrode to cause opposing discharge to occur as erasing discharge between the scanning electrode and the data electrode in response to the leading edge of the sustaining charge erasing pulse and the bias pulse and to cause surface discharge to occur as erasing discharge between the scanning electrode and the sustaining electrode in response to the trailing edge of the bias pulse.

Also, a preferable mode is one wherein pulse width of the data bias pulse is larger than that of the sustaining charge erasing pulse and causes additional opposing discharge to occur as erasing discharge in response to the trailing edge of the sustaining charge erasing pulse.

Also, a preferable mode is one that wherein comprises steps of, during a sustaining charge erasing period, applying a first sustaining charge erasing pulse to the scanning electrode and applying a bias pulse having a leading edge synchronized to that of the first sustaining charge erasing pulse, the same polarity and pulse width as those of the first sustaining charge erasing pulse to the sustaining electrode to cause opposing discharge to occur as erasing discharge between the scanning electrode and the data electrode, and then applying a pulse having polarity being opposite to the bias pulse to the sustaining electrode and a pulse having the same polarity as that of the first sustaining charge erasing pulse to the scanning electrode to cause surface discharge to occur as erasing discharge between the scanning electrode and sustaining electrode.

Also, a preferable mode is one that wherein comprises steps of applying, at a time behind the trailing edge of the sustaining charge erasing pulse, a voltage as first additional sustaining charge erasing pulse to either of the sustaining electrode used as a cathode and the scanning electrode used as an anode to cause additional surface discharge to occur as erasing discharge.

Also, a preferable mode is one that wherein comprises steps of applying, at a time behind the trailing edge of the first sustaining charge erasing pulse, a voltage showing a slow change as a second additional sustaining charge erasing pulse to either of the sustaining electrode used as an anode and the scanning electrode used as a cathode.

Furthermore, a preferable mode is one wherein, during a sustaining discharge period, sustaining pulses having the same polarity only are applied to the scanning electrode and sustaining pulses of the opposite polarity are not applied to the scanning electrode.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

According to a first embodiment of the present invention, during a sustaining charge erasing period, a sustaining charge erasing pulse is applied to a scanning electrode, a bias pulse having a leading edge synchronized to that of a sustaining charge erasing pulse, the same polarity as that of the sustaining charge erasing pulse and having pulse width being shorter than that of the sustaining charge erasing pulse is applied to cause only an opposing discharge to occur as an erasing discharge between the scanning electrode and the data electrode in response to the leading edge of the sustaining charge erasing pulse and the bias pulse and to cause surface discharge to occur as erasing discharge between the scanning electrode and the sustaining electrode in response to a trailing edge of the bias pulse.

Figure 1:
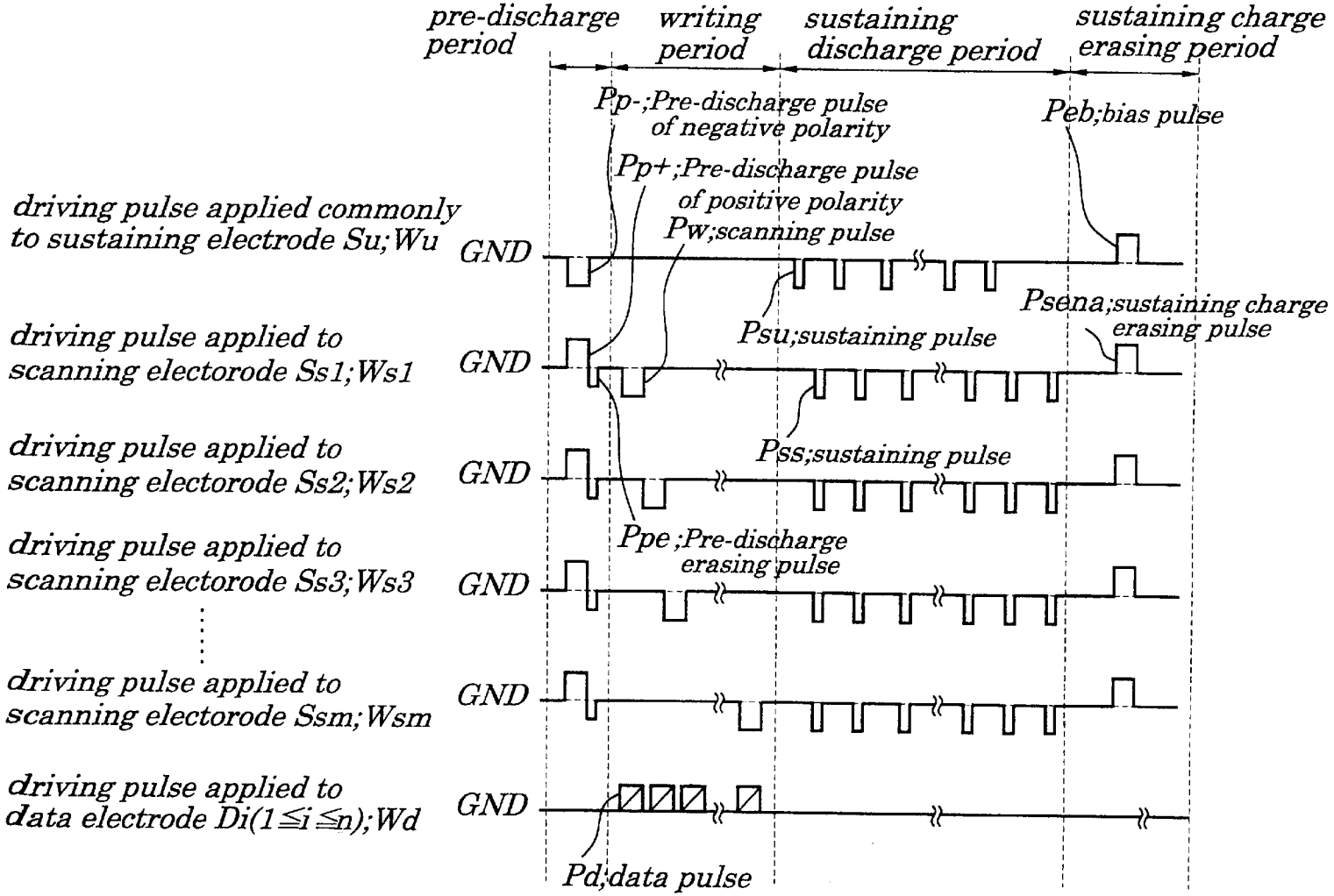
FIG. 1 is a waveform chart showing driving pulses of each of electrodes including a scanning electrode, a sustaining electrode and a data electrode of the first embodiment for operations and method for driving an AC discharge memory-type plasma display panel.
Figure 2:
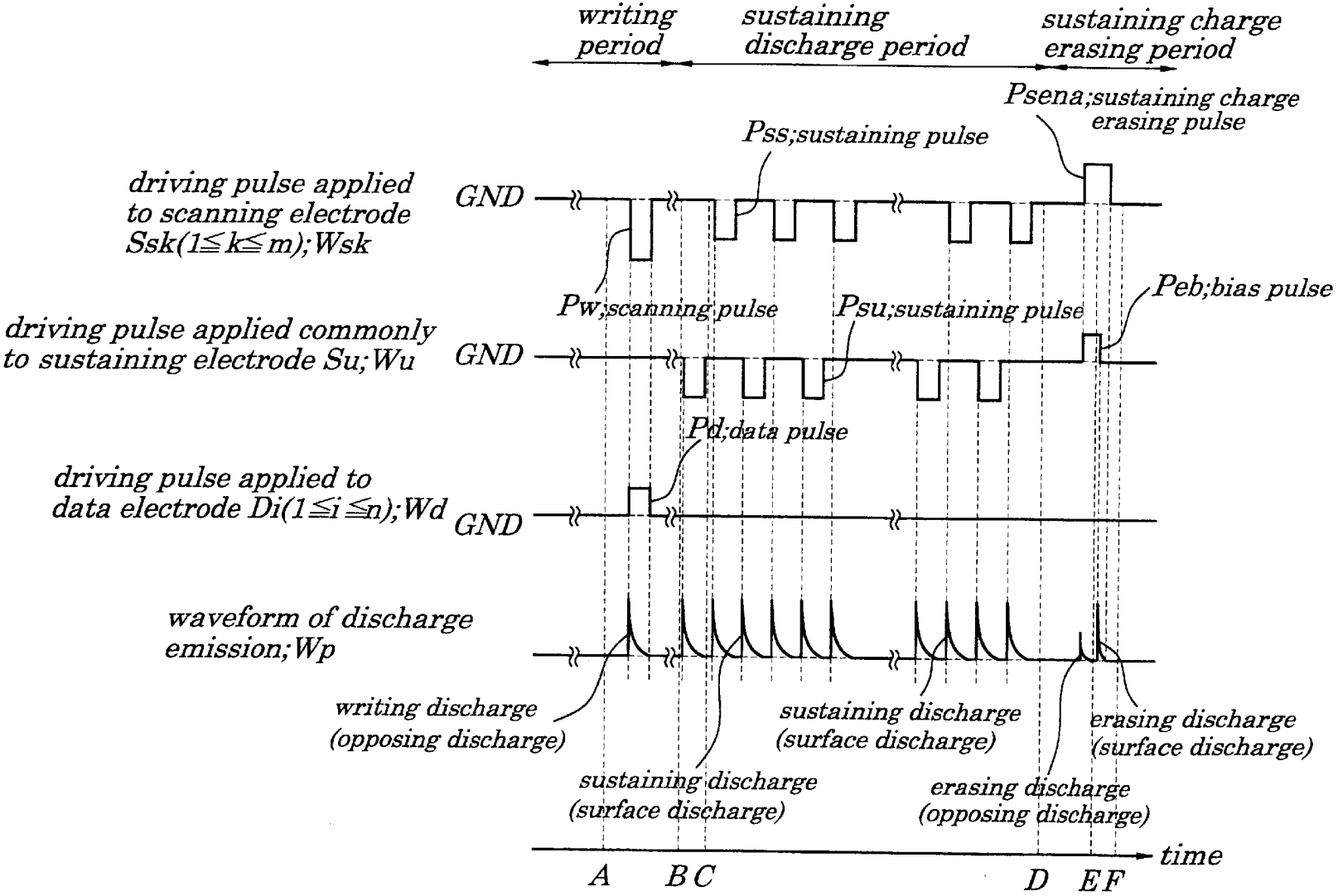
FIG. 2 is an expanded diagram showing waveforms of driving pulses and discharge emission from writing period to sustaining charge erasing period in a display cell in which writing discharge is performed.

Detailed operations and method for driving an AC discharge memory-type plasma display panel according to the first embodiment of the present invention are hereinafter described by referring to FIG. 1, FIG. 2 and FIGS. 3A through 3F. FIG. 1 is a waveform chart showing driving pulses of each of electrodes including the scanning electrode, sustaining electrode and data electrode of the first embodiment for operations and method for driving an AC discharge memory-type plasma display panel. As shown in FIG. 1, the driving operations of the plasma display panel includes a pre-discharge period, a writing period, a sustaining discharge period and a sustaining charge erasing period. Operations in the pre-discharge period are the same as in the conventional driving technologies and detailed description is omitted accordingly. In the pre-discharge period, active particles are produced in the discharge gas space so as to obtain stable writing discharging characteristics during the writing period. As shown in FIG. 2, a cell is selected and a scanning pulse Pw of the negative polarity is applied to a scanning electrode Ssk ($1 \leqq k \leqq m$) for writing, and data pulse Pd of the positive polarity synchronized to the scanning pulse Pw is applied to a data electrode Di ($1 \leqq k \leqq n$) . At this point, at a cell existing at the point of intersection of the scanning pulse Ssk and the data electrode Di, an external voltage supplied by a scanning pulse Pw and the data pulse Pd exceeds an opposing discharge starting voltage between the scanning electrode and the data electrode, resulting in the occurrence of discharging. Furthermore, at this point, as a voltage is applied by the scanning pulse Pw between the scanning electrode and the sustaining electrode, discharge occurs between the scanning electrode and the scanning electrode by induction of opposing discharge. Due to the occurrence of discharge, wall charges that can counteract the external voltage is generated on each electrode.

As described, the opposing discharge represents discharge that occurs between the scanning electrode and the data electrode and between the sustaining electrode and the data electrode. On the other hand, discharge occurring between the scanning electrode and the sustaining electrode is called "surface discharge".

In the subsequent sustaining discharge period, a sustaining pulse Psu of the negative polarity is applied to the sustaining electrode and then a sustaining pulse Pss having the same polarity as the sustaining pulse Psu that lags 180 degrees is applied to all scanning electrodes.

As a result, during the writing period, since wall charges generated by the writing discharge is held at a point of the timing B in FIG. 2, an internal voltage supplied by wall charges on the sustaining electrode and the scanning electrode is superposed upon an external voltage supplied by the sustaining pulse Psu, and effective voltage applied to the discharge gas space exceeds a surface discharge starting voltage, thus causing the surface discharge to occur.

The surface discharge causes wall charges, that counteracts an external voltage supplied by the sustaining pulse Psu, to be generated on the scanning electrode and the sustaining electrode, which is still held at a point of the timing C in FIG. 2

Next, when the sustaining pulse Pss is applied, internal voltage supplied by wall charges at a point of the timing C is superposed on this external voltage and effective voltage applied to the discharge gas space exceeds a surface discharge starting voltage, causing surface discharge to occur.

The surface discharge causes wall charges, that counteracts the external voltage supplied by the sustaining pulse Psu, to be generated on the scanning electrode and the sustaining electrode.

Similarly, the surface discharge is induced by alternate application of the sustaining pulses Psu and Pss which is repeated until desired luminance is obtained. On the other hand, during the writing period, in a display cell where writing discharge does not occur and wall charges are not produced, even if the sustaining pulse Psu and the sustaining pulse Pss are applied alternately, the surface discharge would not occur.

Next, during the sustaining charge erasing period, a sustaining charge erasing pulse Psena being of the positive polarity to a data electrode is applied to all scanning electrodes. On the other hand, a bias pulse Peb having the same polarity as that of the sustaining charge erasing pulse is applied to a sustaining electrode. A rise of the sustaining charge erasing pulse Psena is synchronized to that (leading edge) of the bias pulse Peb and a fall of the bias pulse Peb is faster by 0.5 to 2 micro seconds than the sustaining charge erasing pulse Psena.

At the time immediately before the sustaining charge erasing period, i.e., at a point of the timing D shown in FIG. 2, though a wall charge generated by a final sustaining pulse in the sustaining discharge period is held, wall charges are superposed on the sustaining charge erasing pulse Psena. On the other hand, because the bias pulse Peb has the polarity that counteracts the wall charges, only the effective voltage in discharge gas space between the scanning electrode and the data electrode exceeds a discharge starting voltage and thus discharge erasing discharge occurs between opposing electrodes. If, then, the bias pulse Peb falls, the effective voltage between the scanning electrode and the scanning electrode exceeds the discharge starting voltage and erasing discharge between surface electrodes occurs.

Figure 3A:
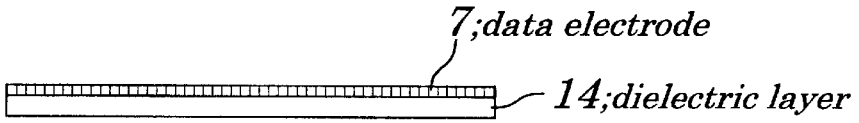
FIGS. 3A through 3F are schematic diagrams illustrating states of wall charges on each of electrodes including the scanning electrode, sustaining electrode and data electrode at a point of the timing A to F shown in FIG. 2.

By referring to FIGS. 3A through 3F, a change in states of wall charges from writing period to sustaining charge erasing period shown in FIG. 2 is described. FIGS. 3A through 3F are schematic diagrams illustrating states of wall charges on each of electrodes including the scanning electrode, sustaining electrode and data electrode at a point of timing A to F shown in FIG. 2. FIG. 3A shows a state at a point of the timing A shown in FIG. 2, i.e., a state immediately before the writing discharge.

As shown in FIG. 2, during the writing period, the scanning pulse Pw is applied to the scanning electrode and, in order to select a display cell, the data pulse Pd is applied to the data electrode. Even if either the scanning pulse or the data pulse Pd only is applied to the display cell, the writing discharge does not occur. Only when both the scanning pulse Pw and the data pulse Pd are simultaneously applied to the display cell, the writing discharge occurs.

Figure 3B:
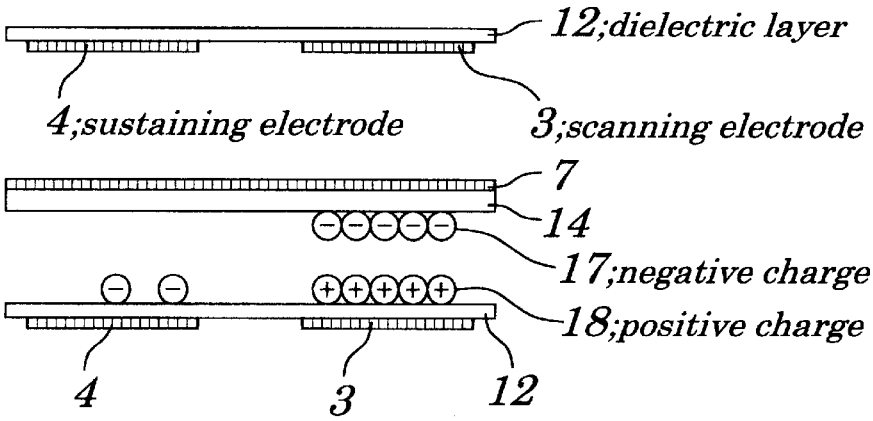

In the embodiment, since a pulse of the negative polarity is used as the scanning pulse Pw and a pulse of the positive polarity as the data pulse Pd, a positive electric charge of charged particles generated by discharge is attracted to the scanning electrode and accumulated as wall charges, and a negative electric charge is attracted to the data electrode and is accumulated as wall charges. Thus, since the internal voltage produced by the accumulated wall charges counteracts the external voltages of the scanning pulse Pw and the data pulse Pd, the effective voltage applied to the discharge gas space is lowered as the discharge grows and finally the discharge stops. As a result, as shown in FIG. 3B, after the writing discharge, positive charges 18 are accumulated on the scanning electrode and negative charges 17 on the data electrode as wall charge respectively.

During the sustaining discharge period, the sustaining pulse Psu of the negative polarity is applied to the sustaining electrode to start the sustaining discharge. At this point, as depicted in FIG. 3B, the positive charge 18 generated by the writing discharge has been accumulated on the scanning electrode, when the sustaining pulse Psu is applied to the sustaining electrode, the internal voltage produced by the positive charge 18 existing on the scanning electrode is superposed on the external voltage produced by the sustaining pulse Psu, causing the effective voltage to exceed the surface discharge starting voltage. Accordingly, the sustaining discharge occurs between the scanning electrode and the sustaining electrode.

Figure 3C:
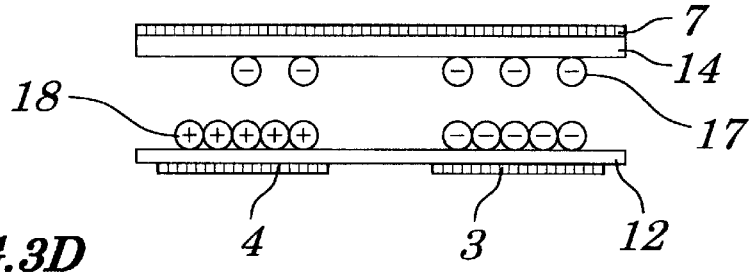

Since positive charges 18 and negative charges 17 are produced by the sustaining discharge and the sustaining pulse Psu of the negative polarity is applied to the sustaining electrode, the positive charges 18 are attracted to the sustaining electrode and the negative charges 17 to the scanning electrode by electrostatic attractive force. As a result, wall charges are accumulated so that an internal voltage interacting an external voltage produced by the sustaining pulse Psu is applied, and the effective voltage to be applied to the discharge gas space is lowered, causing the discharge tobe stopped. Therefore, as shown in FIG. 3C, the positive charges 18 are accumulated on the sustaining electrode and the negative charges 17 on the scanning electrode.

When the sustaining pulse Pss, that has the same polarity as that of the sustaining pulse Psu and lags 180 degrees behind the pulse Psu, is applied to the scanning electrode, since the internal voltage produced by wall charges generated by the previous discharge is superposed on the external voltage supplied by the sustaining pulse Pss, the effective voltage in the discharge gas space exceeds the surface discharge starting voltage, causing the sustaining discharge again to occur. The positive and negative electric charges generated by this discharge are accumulated, in the same manner as in the sustaining discharge, so that they counteract the external voltage on the scanning and sustaining electrodes, and the discharge stops. At this point, as shown in FIGS. 2 (states at a point of the timing D) and 3D, the positive charge 18 is accumulated on the scanning electrode as wall charges and the positive charge 18 on the data electrode as wall charges. After that, discharge is repeated by alternate application of Psu and Pss. The sustaining discharge is continued until desired luminance is obtained.

Figure 3D:
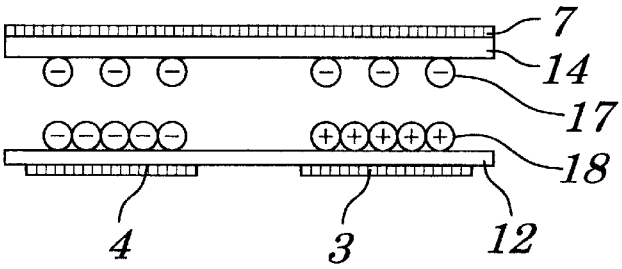

On the other hand, since both the sustaining pulse Pss and Psu are of the negative polarity to the data electrode, the data electrode attracts the negative charges 17 during the sustaining discharge period. As seen in FIG. 3D, before the application of the sustaining charge erasing pulse Psena, the negative charges 17 are accumulated. Moreover, since the last sustaining pulse in the sustaining discharge period is applied to the scanning electrode, positive charges 18 are accumulated on the scanning electrode and negative charges 17 are accumulated on the sustaining electrode after the application of the final sustaining pulse.

During the sustaining charge erasing period, the sustaining charge erasing pulse Psena is applied to the scanning electrode and the bias pulse Peb is applied to the sustaining electrode. At this point, at a point of timing D in FIG. 2, wall charges superimposed on the sustaining charge erasing pulse Psena act, on the scanning electrode, so as to increase the effective voltage of the positive potential and on the sustaining electrode, so as to counteract the bias pulse Peb and to decrease the effective voltage of the positive potential and on the data electrode, so as to cause the effective voltage of negative potential to be at a further lower potential. Therefore, by setting each voltage of the sustaining charge erasing pulse Psena and the bias pulse Peb to an appropriate value, it is possible to cause only opposing discharge to occur between the scanning electrode and the data electrode and surface discharge between the scanning electrode and the sustaining electrode and opposing discharge between the sustaining electrode and the data electrode to be suppressed.

For example, if the discharge starting voltage among electrodes is 200 V, the voltage of the wall charges produced after the sustaining discharge is +30 V on the scanning electrode, −30 V on the sustaining electrode and −60 V on the data electrode, a voltage of the sustaining charge erasing pulse Psena may be 170 V and a voltage of the bias pulse Peb may be 80 V. These values can be obtained from the following formula to get the effective voltage among electrodes.

Effective voltage between scanning electrode and data electrode= (170V+30V)−(−60V)=260 V (>200V)

Effective voltage between scanning electrode and sustaining electrode=(170V+30V)−[80V+(−30V)]=150 V (<200V)

Effective voltage between sustaining electrode and data electrode= [80V+(−30V)]−(−60V)=110 V (<200 V)

Figure 3E:
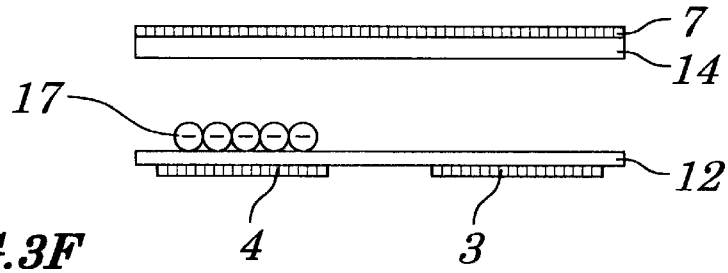

Though a protective layer made of materials having a large secondary emission coefficient such as MgO is formed on the scanning electrode, since a phosphor is provided on the data electrode, if discharge using the data electrode as a cathode between the scanning electrode and the data electrode only occurs, because the discharge does not grow to become strong one, wall charges are readily reduced, thus making the erasing discharge controllable. Accordingly, as shown in FIG. 3E, at a point of the timing E, wall charges on the scanning electrode and the data electrode have been erased.

Next, when the bias pulse Peb falls, wall charges at a point of the timing E are superposed, on the sustaining electrode, on the effective voltage having the negative potential, supplied by the sustaining charge erasing pulse Psena and acts so as to cause the sustaining electrode to be at a lower potential. On the other hand, since wall charges on the data electrode and scanning electrode are erased, the effective voltage between the scanning electrode and the sustaining electrode can be given by the following formula:

(170V+0V)−[0V+(−30V)]=200V (=200V)

This means that the voltage reaches the surface discharge starting voltage at the scanning electrode and at the sustaining electrode, the surface discharge occurs as erasing discharge.

In the surface discharge, because the sustaining charge erasing pulse Psena falls 0.5 to 2 microseconds after the falling of the bias pulse Peb, the time during which a voltage between the scanning electrode and the sustaining electrode is applied is as short as 0.5 to 2 microseconds, thus performing erasing operation by a pulse having a short width.

Figure 3F:
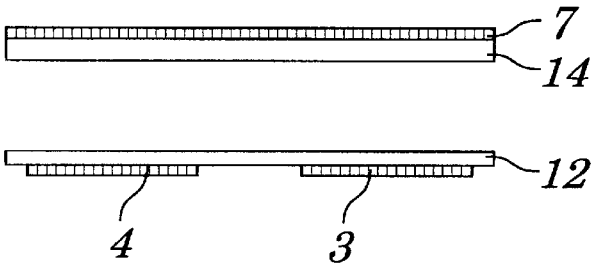

While most of charged particles in space of discharge gas generated during the discharge are not attracted into the dielectric layer and they stay in the discharge gas space, since a voltage is released, wall charges accumulated on the electrode immediately after the fall of the sustaining charge erasing pulse Psena attract a great amount of charged particles floating in the discharge gas space by electrostatic attractive force and the wall charges are re-bound on the electrode and neutralized spontaneously. As a result, wall charges on each electrode after the application of the sustaining charge erasing pulse Psena are as shown in FIG. 3F and wall charges on the scanning and sustaining electrodes are erased.

Controllability of electric charges on the data electrode is improved by achieving temporal separation of discharge between opposing electrodes by the sustaining charge erasing pulse Psena from discharge between surface electrodes, such as surface discharge subsequent to opposing discharge. The reason is described below.

Figure 11:
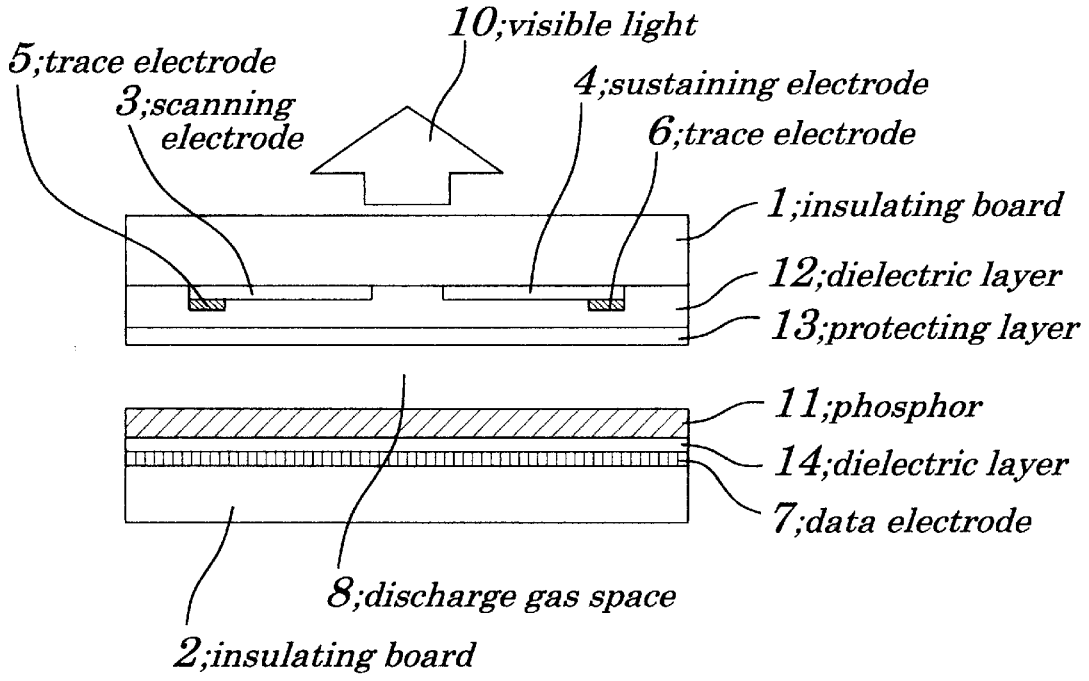
FIG. 11 (PRIOR ART)
FIG. 11 is a cross-sectional diagram illustrating configurations of one display cell of an AC discharge memory-type PDP.
Figure 12:
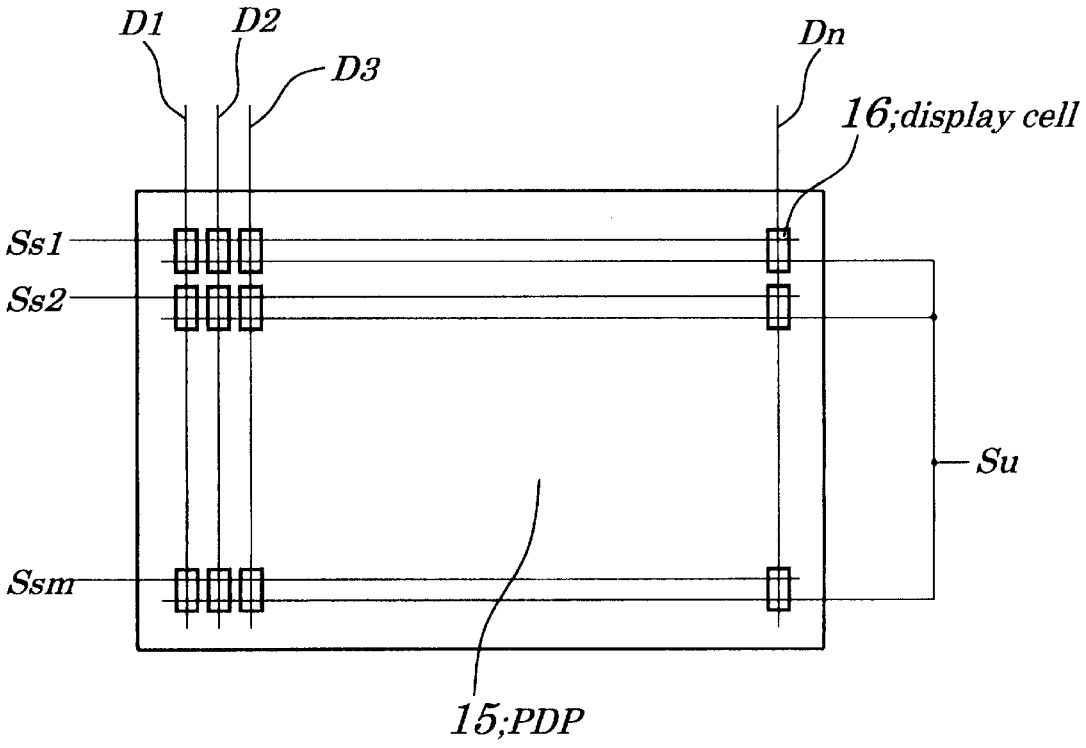
FIG. 12 (PRIOR ART)
FIG. 12 is a top plan view of approximate configurations of the PDP composed of display cells disposed in a matrix state shown in FIG. 11.

As shown in FIG. 11, the data electrode 7 is provided a phosphor 11 contacting with the discharge gas space 8 and the scanning electrode 3 and the sustaining electrode 4 are provided with a protecting layer 13. The protective layer 13 is made of a material having a large secondary emission coefficient such as magnesium oxide (MgO) or the like. Therefore, in the case of discharge using the scanning electrode 3 or the sustaining electrode 4 as a cathode, since the secondary emission coefficient is large, the discharge starting voltage is low and the growth of generated discharge is rapid. On the other hand, in the case of discharge using the data electrode 7 as a cathode, since the secondary emission coefficient is small and the growth of generated discharge is slow.

Figure 13:
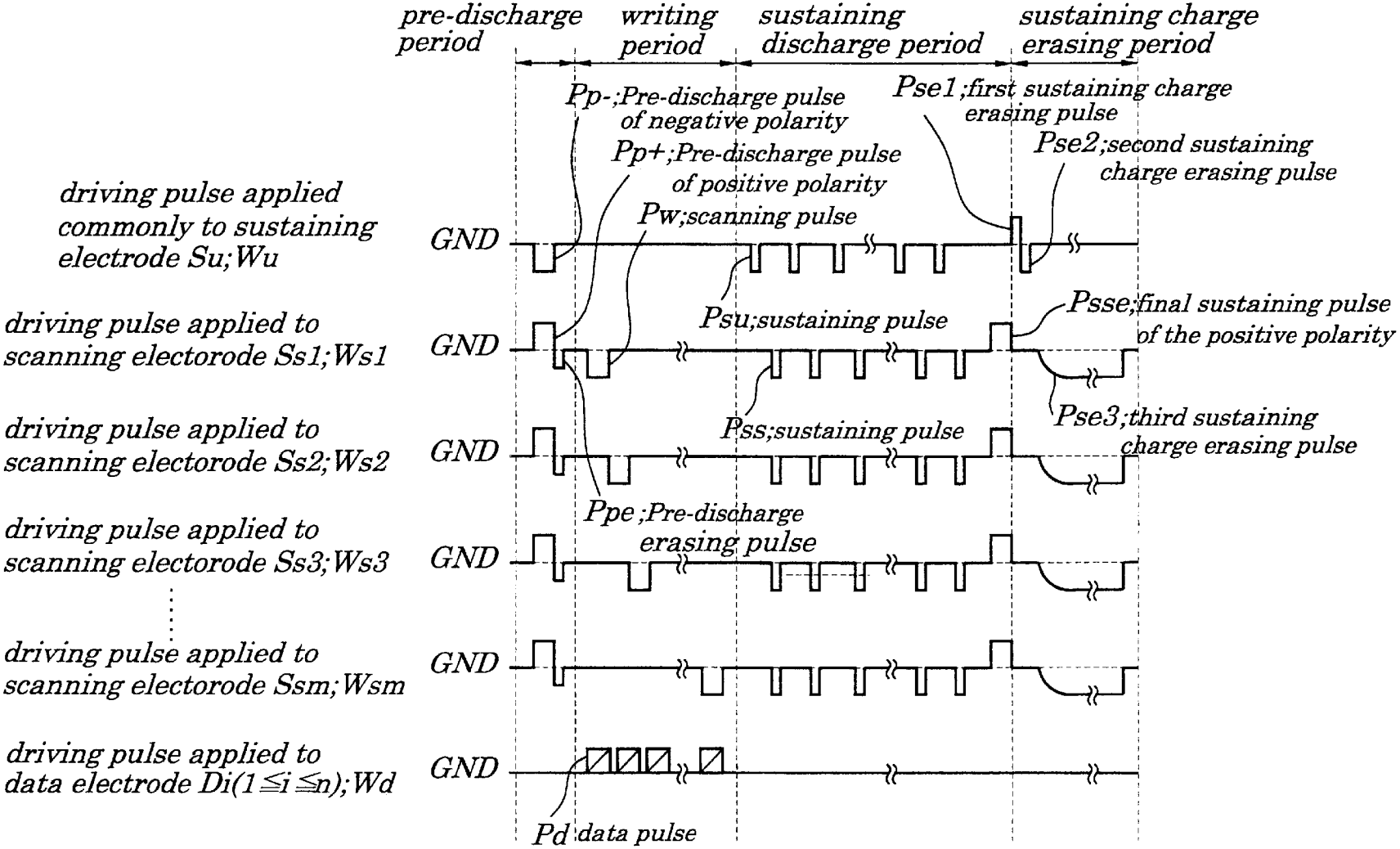
FIG.13 (PRIOR ART)
FIG. 13 is a waveform diagram of a driving pulse illustrating a method of driving the PDP shown in FIG. 11, which shows an embodiment disclosed in Japanese Laid-Open Patent Application No. Hei10-274955.
Figure 14:
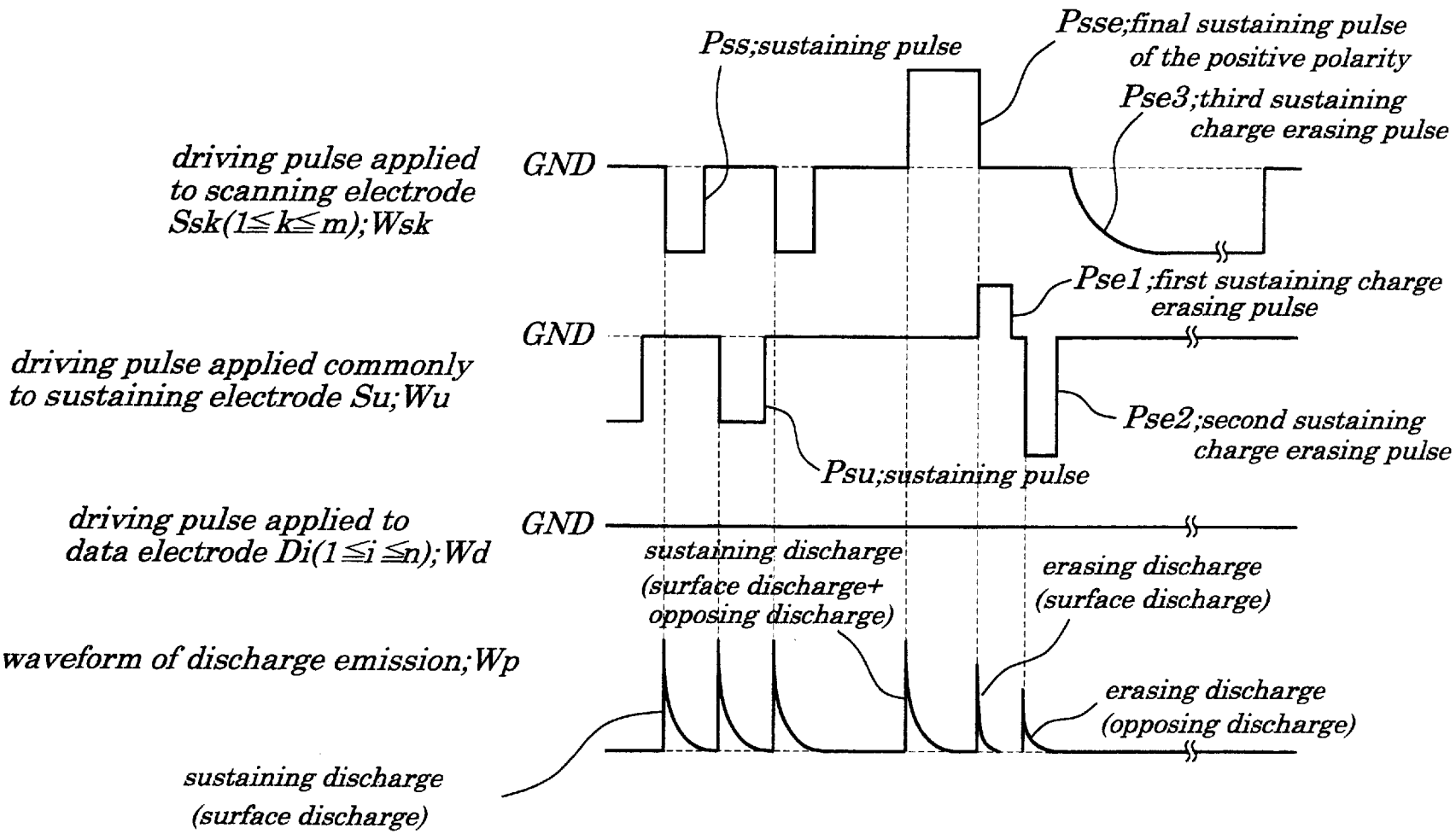
FIG.14 (PRIOR ART)
FIG. 14 is an expanded diagram showing waveforms appeared during the latter half of the sustaining discharge period and during the sustaining charge erasing period in an embodiment disclosed in Japanese Laid-Open Patent Application No. Hei10-274955.

If surface discharge and opposing discharge occur simultaneously as in the case of conventional technologies, the opposing discharge that cannot grow singly to strong discharge grows to strong discharge due to active particles generated in the discharge gas space by the surface discharge. Moreover, by the influence of the strong opposing discharge, the surface discharge grows to strong discharge. As shown in FIG. 13, if the opposing discharge and surface discharge simultaneously occur by a final sustaining pulse of positive polarity, it is difficult to control, with stability, electric charges on the data electrode.

According to the present invention, during the sustaining charge erasing period, temporal separation of opposing discharge from surface discharge is made wherein the opposing discharge does not grow due to no existence of active particles generated by the surface discharge and converges as weak discharge. In the subsequent surface discharge, active particles at the discharge is smaller compared with the case where the surface discharge and opposing discharge occur simultaneously, and the discharge is made weakened. That is, the opposing discharge and surface discharge do not interact with each other and operate independently. Therefore, if the separation of the opposing discharge performed by the sustaining charge erasing pulse Psena from the surface discharge is made, since the opposing discharge and the surface discharge do not interact with each other and the opposing discharge converges while the discharge remains weak, no wall charges stay. Furthermore, a change in the sustaining discharge caused by a display load has no influence on the opposing discharge, control of data electrode is made with stability.

In the conventional technologies, it is difficult to control electric charges on the data electrode and erasability is not sufficient. According to the present invention, erasing of charges on the data electrode is performed with stability and reliable control of driving is made possible.

As is clear from the description of the first embodiment, characteristics of the method of driving the AC discharge memory-type plasma display panel lie in its method of applying driving pulses during the sustaining charge erasing period. In the embodiments from second to seventh, operations of the pre-discharge period, writing period and sustaining discharge period are the same as those in the first embodiment and accordingly the description is omitted. Methods of applying driving pulses during the sustaining charge erasing period are mainly described.

Second Embodiment

According to a second embodiment, during a sustaining charge erasing period, a first sustaining charge erasing pulse is applied to a scanning electrode and a bias pulse having a leading edge synchronized to that of a sustaining charge erasing pulse, the same polarity as that of the first sustaining charge erasing pulse and having the same pulse width as that of the first sustaining charge erasing pulse is applied to cause an opposing discharge to occur as erasing discharge between a scanning electrode and a data electrode in response to the leading edge of the sustaining charge erasing pulse and the bias pulse and to cause surface discharge to occur as erasing discharge between the scanning electrode and then a second sustaining charge erasing pulse having the same polarity as that of the first sustaining charge erasing pulse is applied only to the scanning electrode to cause surface discharge to occur as erasing discharge between the scanning electrode and the sustaining electrode.

Figure 4:
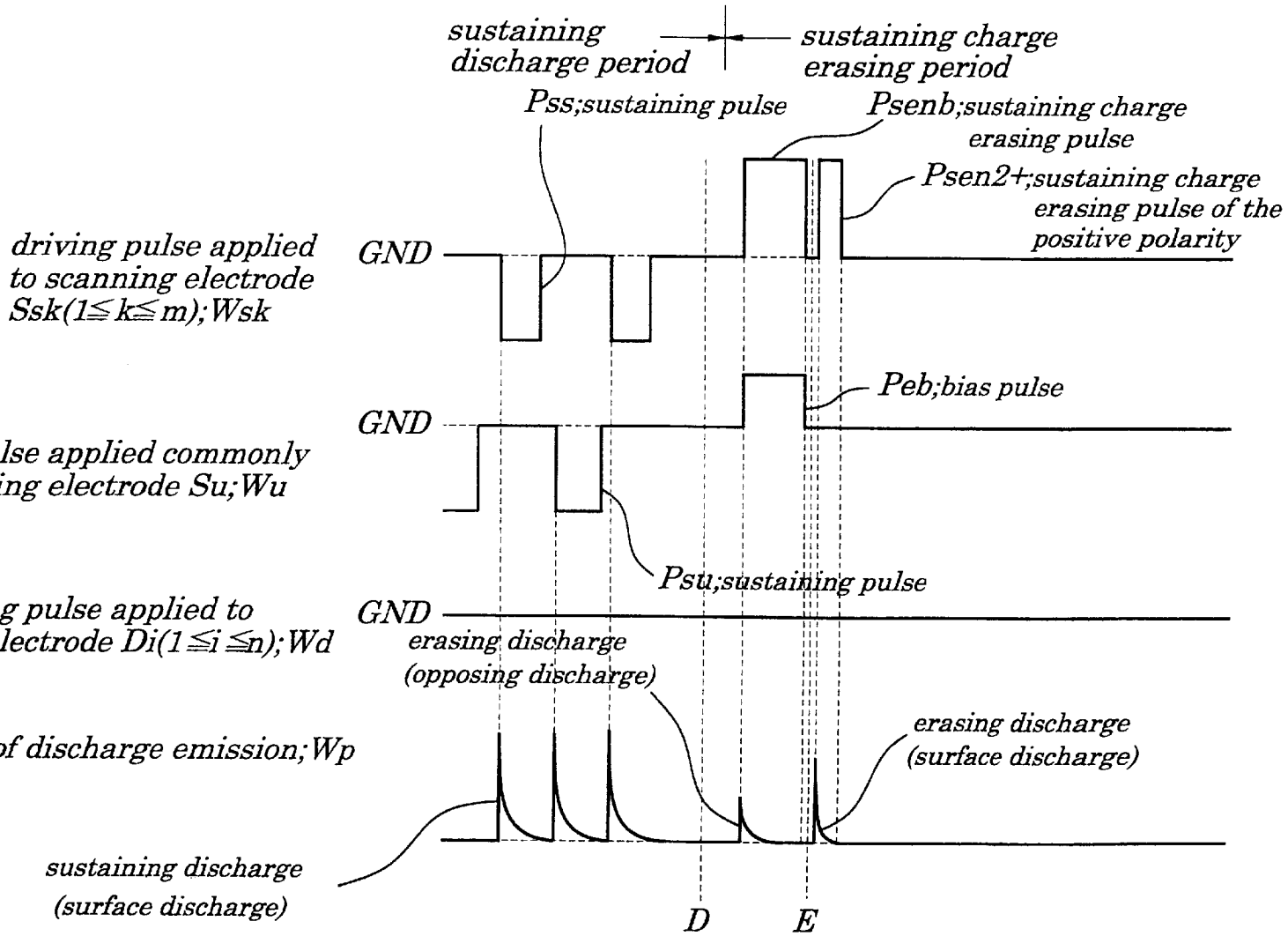
FIG. 4 is an expanded diagram showing waveforms of driving pulses and waveforms of discharge emission at a final stage of the sustaining discharge period and during sustaining charge erasing period in the AC discharge memory-type plasma display panel according to the second embodiment.

Detailed operations and method of driving an AC discharge memory-type plasma display panel according to a second embodiment of the present invention are hereinafter described by referring to FIG. 4. FIG. 4 is an expanded diagram illustrating a waveform of a driving pulse and waveforms Wp of discharge emission at a final stage of a sustaining discharge period including a point of timing corresponding to the timing D in FIG. 2 and during the sustaining charge erasing period including a point of timing corresponding to the timing E in FIG. 2 according to the second embodiment.

According to the second embodiment, as shown in FIG. 4, a sustaining charge erasing pulse Psenb (first sustaining charge erasing pulse) is applied to the scanning electrode. While a bias pulse Peb having a rise (leading edge) and a fall (trailing edge) each being synchronized to a rise (leading edge) and a fall (trailing edge) of the sustaining charge erasing pulse Psenb and having a lower potential than that of the sustaining charge erasing pulse Psenb is applied to the sustaining electrode, opposing discharge is allowed to occur as erasing discharge. Then, another pulse called a sustaining charge erasing pulse Psen2 + (second sustaining charge erasing pulse) having the same potential as that of the sustaining charge erasing pulse Psenb and having a narrower pulse width than that of the sustaining charge erasing pulse Psenb is applied only to the scanning electrode, surface discharge is allowed to occur as erasing discharge.

Wall charges act so as to raise the effective voltage on the scanning electrode by being superposed on the sustaining charge erasing pulse Psenb, simultaneously to lower the effective voltage on the sustaining electrode by counteracting the bias pulse Peb and to cause the effective voltage to be at a lower potential on a data electrode.

Accordingly, as in the case of the first embodiment, by setting each voltage of the sustaining charge erasing pulse Psenb and the bias pulse Peb to appropriate values, opposing discharge is allowed to occur, as erasing discharge, between the scanning electrode and the data electrode, and discharging is suppressed between the scanning electrode and the sustaining electrode as well as between the sustaining electrode and the data electrode.

Next, if the sustaining charge erasing pulse of the positive polarity Psen2+ is applied to the scanning electrode, the wall charges at a point of the timing E act so as to cause the effective voltage to be at a lower potential. Since charges are erased both on the data electrode and the scanning electrode, the surface discharge occurs as erasing discharge only between the scanning electrode and the sustaining electrode. The pulse width of the sustaining charge erasing pulse of the positive polarity Psen2+ is adapted to be 0.5 to 2 microseconds so that it acts as an erasing pulse having a short width.

Therefore, temporal separation between the opposing discharge and the surface discharge during the sustaining erasing discharge can be achieved, thus providing the same effect as obtained in the first embodiment.

Third Embodiment

According to a third embodiment of the present invention, during a sustaining charge erasing period, a first sustaining charge erasing pulse is applied to a scanning electrode and a bias pulse having a leading edge synchronized to that of the first sustaining charge erasing pulse, the same polarity as that of the first sustaining charge erasing pulse and having the same pulse width as that of the first sustaining charge erasing pulse is applied to cause opposing discharge to occur as erasing discharge between a scanning electrode and a data electrode, and then a second sustaining charge erasing pulse having polarity being opposite to that of the bias pulse is applied to only the sustaining electrode and to cause surface discharge to occur as erasing discharge between the scanning electrode and sustaining electrode.

Figure 5:
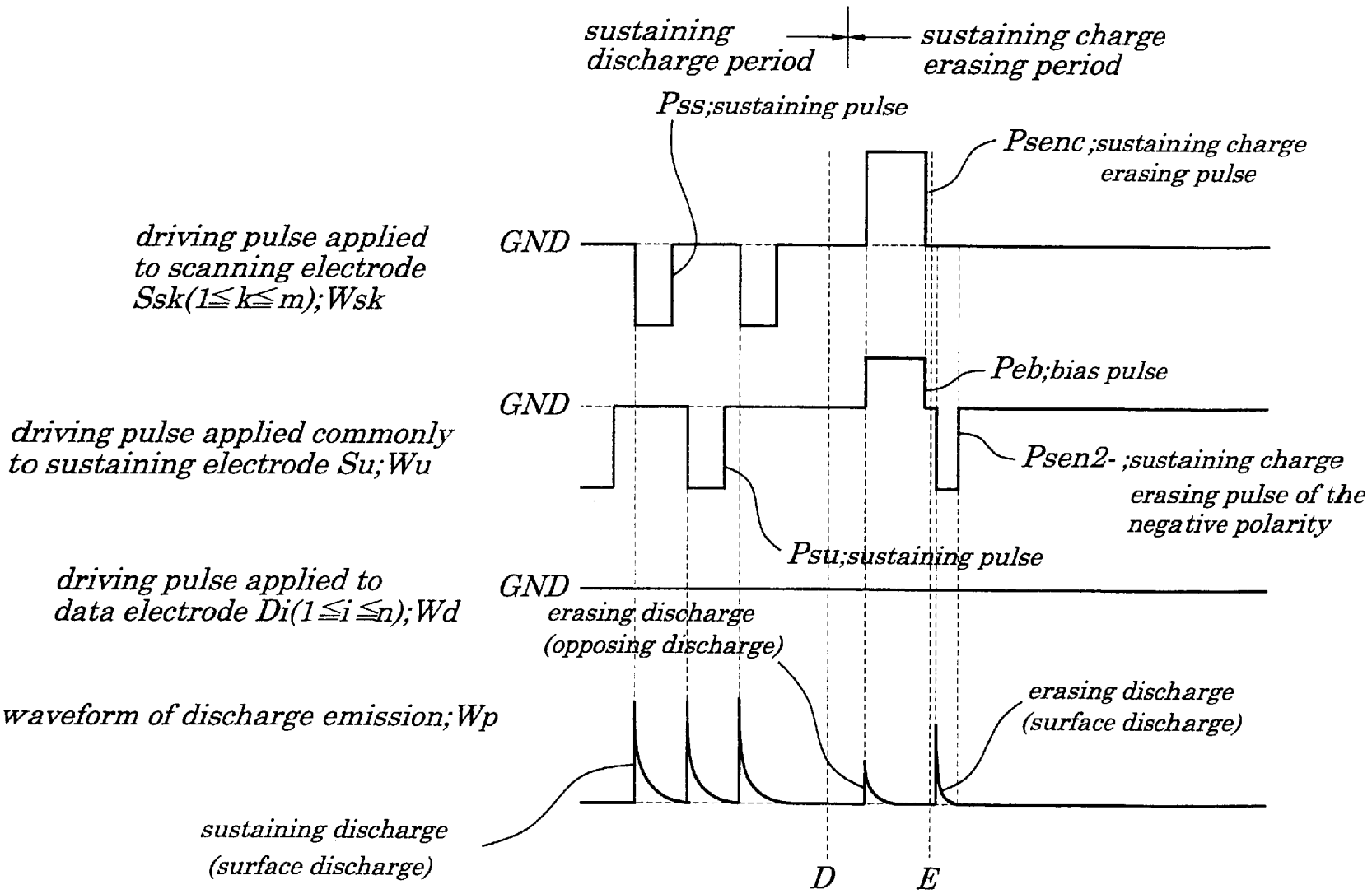
FIG. 5 is an expanded diagram showing waveforms of driving pulses and waveforms of discharge emission at a final stage of the sustaining discharge period and during the sustaining charge erasing period in the AC discharge memory-type plasma display according to a third embodiment.

Detailed operations and method of an AC discharge memory-type plasma display panel according to a third embodiment of the present invention are hereinafter described by referring to FIG. 5. FIG. 5 is an expanded diagram waveforms of driving pulses and waveforms Wp of discharge emission at a final stage of a sustaining discharge period and during a sustaining charge erasing period in the AC discharge memory-type plasma display according to a third embodiment.

As shown in FIG. 5, according to the third embodiment, as in the case of the second embodiment, the opposing discharge performed by a sustaining charge erasing pulse Psenc is allowed to occur and surface discharge is performed by another pulse, the polarity of which is negative. As shown in FIG. 5, more specifically, The sustaining charge erasing pulse Psenc (first sustaining charge erasing pulse) is applied to the scanning electrode and a bias pulse Peb having a rise (leading edge) and a fall (trailing edge) each being synchronized to a rise (leading edge) and a fall (trailing edge) of the sustaining charge erasing pulse Psenc and having a lower potential than that of the sustaining charge erasing pulse Psenc is applied to the sustaining electrode, and then the sustaining charge erasing pulse of the negative polarity Psen2 (second sustaining charge erasing pulse) is applied only to the sustaining electrode.

According to the third embodiment, as in the case of the second embodiment, while the sustaining charge erasing pulse Psenc and the bias pulse Peb are applied, only the opposing discharge between the scanning electrode and the data electrode occurs as erasing discharge, and the discharge is suppressed between the scanning electrode and the sustaining electrode and between the sustaining electrode and the data electrode.

Next, if the sustaining charge erasing pulse of the negative polarity Psen2 is applied, wall charges at a point of the timing E act so as to cause the effective voltage to be at a lower potential by being superposed only on the sustaining charge erasing pulse Psen2. On the other hand, because wall charges are erased both on the data electrode and the scanning electrode during the previous opposing discharge, the surface discharge occurs as erasing discharge only between the scanning electrode and the sustaining electrode. The pulse width of Psen2 is adapted to be 0.5 to 2 microseconds so that the Psen2 acts as an erasing pulse having a short width.

Therefore, temporal separation of the opposing discharge and the surface discharge during the sustaining erasing discharge can be achieved, providing the same effects as in the first and second embodiments. An additional effect is that, since the pulse of the negative polarity is used as the second sustaining charge erasing pulse, unlike in the case of the second embodiment, the collision of positive charges against the data electrode is reduced more compared with the case of using a pulse of the positive polarity. Moreover, a new effect is that, because the collision of positive charges against the data electrode may degrade a phosphor on the data electrode, by preventing the collision of positive charges, the life of the phosphor can be lengthened accordingly.

Fourth Embodiment

According to a fourth embodiment of the present invention, during a sustaining charge erasing period, a sustaining charge erasing pulse having a front-step portion of a first voltage and a rear-step portion of a second voltage being higher than that of the first voltage is applied to a scanning electrode and a data bias pulse having a leading edge being synchronized to that of the sustaining charge erasing pulse (having a front-step portion of a first voltage and a rear-step portion of a second voltage being higher than that of the first voltage), the polarity being opposite to that of the sustaining charge erasing pulse and having the same pulse width as that of the front step of the sustaining charge erasing pulse is applied to the data electrode to cause opposing discharge to occur as erasing discharge between a scanning electrode and a data electrode, in response to the front-step portion of the sustaining charge erasing pulse and the data bias pulse and then to cause surface discharge to occur as erasing discharge between the scanning electrode and the sustaining electrode in response to the rear-step portion of the sustaining charge erasing pulse. Moreover, the sustaining electrode is maintained at a definite potential (GND potential).

Figure 6:
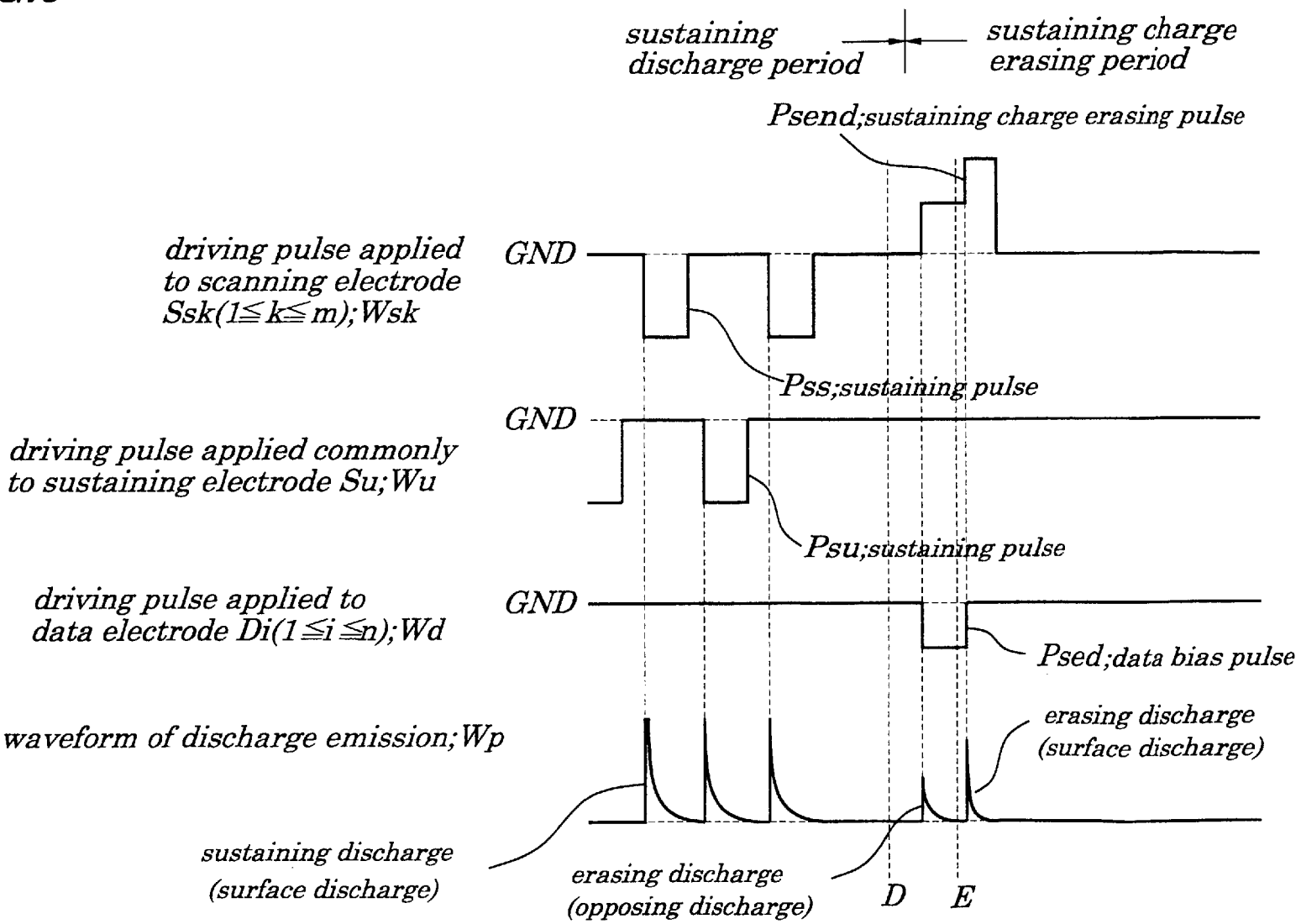
FIG. 6 is an expanded diagram showing waveforms of driving pulses and waveforms of discharge emission at a final stage of the sustaining discharge period and during the sustaining charge erasing period in the AC discharge memory-type plasma display according to a fourth embodiment.

Detailed operations and method of an AC discharge memory-type plasma display panel according to a fourth embodiment of the present invention are hereinafter described by referring to FIG. 5. FIG. 6 is an expanded diagram showing waveforms of driving pulses and waveforms Wp of discharge emission at a final stage of a sustaining discharge period and during a sustaining charge erasing period in the AC discharge memory-type plasma display according to a fourth embodiment.

As shown in FIG. 6, according to the fourth embodiment, a step-form sustaining charge erasing pulse Psend is applied to the scanning electrode. The amplitude of the sustaining charge erasing pulse Psend is smaller in the front-step portion than in the rear step.

The width of the rear-step portion of the sustaining charge erasing pulse Psend is adapted to be 0.5 to 2 microseconds so that it acts as an erasing pulse having a short width. The sustaining electrode is maintained at a definite potential (GND potential). A data bias pulse Psed having the same pulse width as that of the front step portion of the sustaining charge erasing pulse Psend, of the negative polarity and of the opposite polarity against the sustaining charge erasing pulse Psend is applied to the data electrode.

Operations of the fourth embodiment in which a driving pulse is applied to each of electrodes of the scanning electrode, sustaining electrode and data electrode are equivalent to those of the first embodiment in which a driving pulse is applied to the scanning electrode, sustaining electrode and data electrode.

When the front step portion of the sustaining charge erasing pulse Psend and a data bias pulse Psed are applied, the wall charges at a point of the timing D, on the scanning electrode, are superposed on the front step portion of the Psend and act so as to raise the effective voltage having the positive potential and, on the data electrode, are superposed on the data bias pulse Psed and act so as to cause the effective voltage having the negative potential to be at a lower potential and, on the sustaining electrode, are superposed on the front step portion of the sustaining charge erasing pulse Psend and act so as to counteract the effective voltage by the data bias pulse Psed.

For example, if the discharge starting voltage among electrodes is 200 V, the voltage of the wall charges at a point of the timing D is +30 V on the scanning electrode, −30 V on the sustaining electrode and −60 V on the data electrode, and if a voltage of the front-step portion of the sustaining charge erasing pulse Psend is 100 V and a voltage of the data bias pulse is −70 V, the effective voltage supplied to each electrode is given by the following formula:

Effective voltage between scanning electrode and data electrode= (100V+30V)−[−70V+(−60V)]=260V (>200V)

Effective voltage between scanning electrode and sustaining electrode=(100V+30V)−(−30V)=160 V (<200V)

Effective voltage between sustaining electrode and data electrode= (−30V)−[−70V+(−60V)]=100 V (<200V)

Accordingly, the erasing discharge (opposing discharge) occurs between the scanning electrode and the data electrode, however, the discharge does not occur between the scanning electrode and the sustaining electrode, and between the sustaining electrode and the data electrode.

After that, the data bias pulse Psed is returned to its ground potential and the latter step portion of the sustaining charge erasing pulse Psend rises. Because the negative wall charges on the sustaining electrode at a point of the timing E has a potential which is lower than that on the sustaining electrode, for example, if the voltage of the later step portion of the sustaining charge erasing pulse Psend is 170V, the effective voltage between the scanning electrode and the sustaining electrode=(170V+0V)−[0V+(−30V)]=200 V (=200V).

Thus, the effective voltage between the scanning electrode and the sustaining electrode becomes large and reaches the sustaining starting voltage, causing discharge between the scanning electrode and the sustaining electrode to occur. On the other hand, since wall charges are erased on the scanning electrode and the data electrode, discharge does not occur. Since the width of the latter step portion of the sustaining charge erasing pulse Psend is 0.5 to 2 microseconds, the Psend acts as an erasing pulse having a short width. Therefore, temporal separation of the sustaining from the surface discharge during the sustaining erasing discharge is achieved.

Fifth Embodiment

According to a fifth embodiment of the present invention, during a sustaining charge erasing period, a sustaining charge erasing pulse is applied to the scanning electrode and a bias pulse having a leading edge being synchronized to that of the sustaining charge erasing pulse, the same polarity as that of the sustaining charge erasing pulse and a pulse width being shorter than that of the sustaining charge erasing pulse is applied to the sustaining electrode to cause only opposing discharge to occur as erasing discharge between the scanning electrode and the data electrode, then a data bias pulse having a leading edge being faster than a trailing edge of the bias pulse and the trailing edge being synchronized to that of the sustaining charge erasing pulse and having the same polarity as that of the sustaining charge erasing pulse to the data electrode to cause only surface discharge to occur as erasing discharge between the scanning electrode and the sustaining electrode in response to the trailing edge of the bias pulse.

Figure 7:
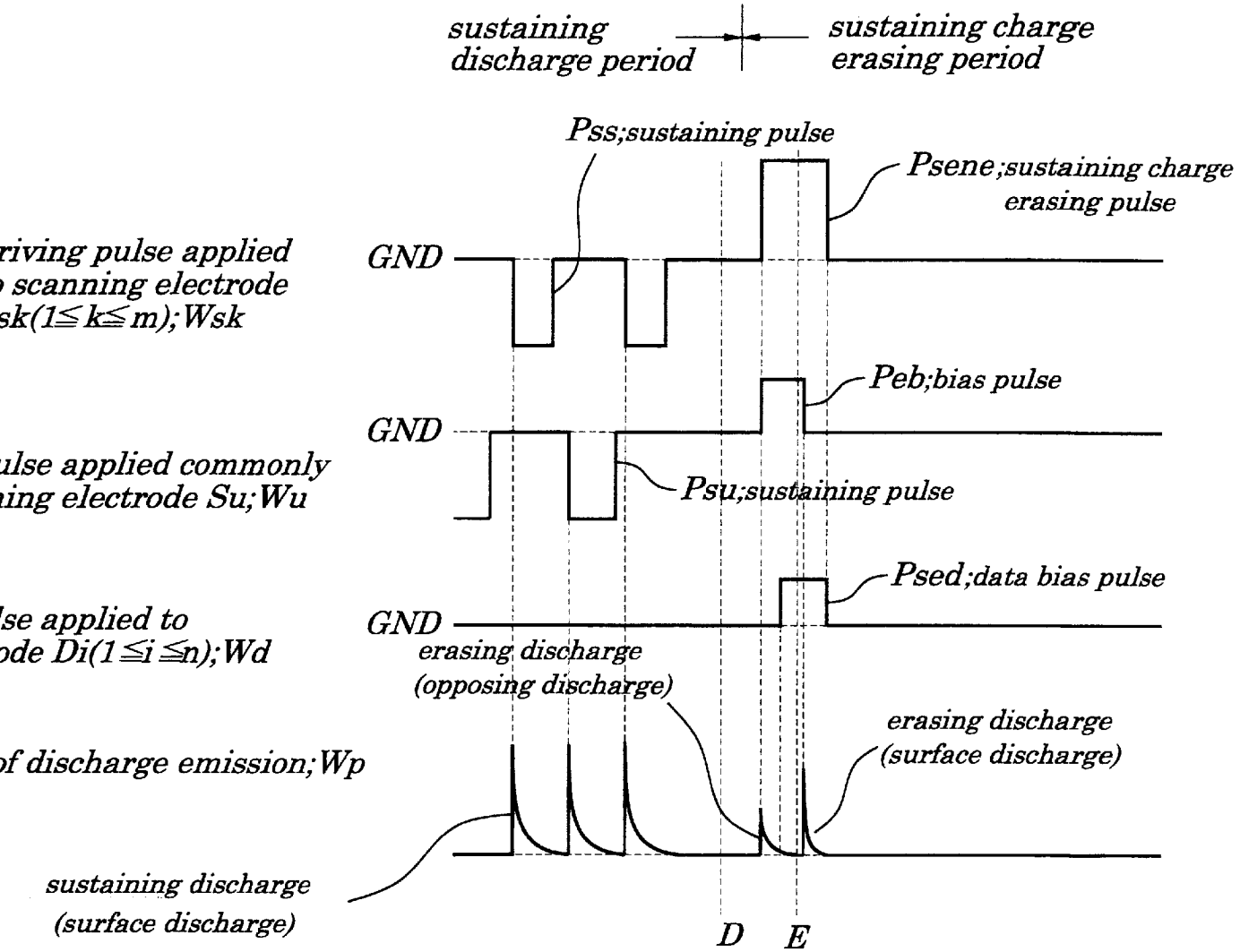
FIG. 7 is an expanded diagram showing waveforms of driving pulses and waveforms of discharge emission at a final stage of the sustaining discharge period and during the sustaining charge erasing period in the AC discharge memory-type plasma display according to a fifth embodiment.

Detailed operations and method of an AC discharge memory-type plasma display panel according to a fifth embodiment of the present invention are hereafter described by referring to FIG. 7. FIG. 7 is an expanded diagram showing waveforms of driving pulses and waveforms Wp of discharge emission at a final stage of a sustaining discharge period and during a sustaining charge erasing period in the AC discharge memory-type plasma display according to a fifth embodiment.

As shown in FIG. 7, according to the fifth embodiment, a sustaining charge erasing pulse Psene is applied to the scanning electrode and a bias pulse Peb having a rise (leading edge) being synchronized to a rise (leading edge), and a fall (trailing edge) of the sustaining charge erasing pulse Psene falling more rapidly than the fall (trailing edge) of the sustaining charge erasing pulse Psene, being of the same polarity as that of the sustaining charge erasing pulse Psene and having a lower potential than that of the sustaining charge erasing pulse Psena is applied to the sustaining electrode. After the opposing discharge by the application of the sustaining charge erasing pulse Psene occurs, a data bias pulse Psed of the same polarity as for the sustaining charge erasing pulse Psene is applied to the data electrode. For example, the data bias pulse Psed is applied 0.5 to 2 microseconds after the application of the sustaining charge erasing pulse Psene and the fall (trailing edge) of the data bias pulse Psed is in synchronization with the fall (trailing edge) of the sustaining charge erasing pulse Psene.

When the sustaining charge erasing pulse Psene and a bias pulse Peb are applied to the scanning electrode and the sustaining electrode in synchronization with each other, as in the first embodiment, the opposing discharge occurs only between the scanning electrode and the data electrode. According to this embodiment, since the data bias pulse Psed of the positive polarity is applied 0.5 to 2 microseconds after the occurrence of the opposing discharge, the effective voltage between the scanning electrode and the data electrode is lowered, causing the discharge to be stopped. Since the time during which the voltage of the sustaining charge erasing pulse Psene is applied between the scanning electrode and the data electrode is 0.5 to 2 microseconds, the opposing discharge is discharge performed by using as an erasing pulse having a short width.

After that, if only the bias pulse Ped falls, as in the first embodiment, discharge only between the scanning electrode and the sustaining electrode occurs. According to this embodiment, since the discharge using an erasing pulse having a short width is adapted as the opposing discharge occurred by the sustaining charge erasing pulse Psene, when the opposing discharge starting voltage is comparatively low, even if a cathode is used, it is possible to suppress too strong opposing discharge.

Sixth Embodiment

According to a sixth embodiment, during a sustaining erasing period, a sustaining charge erasing pulse is applied to a scanning electrode, a bias pulse having a leading edge being synchronized to that of a sustaining charge erasing pulse, the same polarity as that of the sustaining charge erasing pulse and having pulse width being shorter than that of the sustaining charge erasing pulse is applied to the sustaining electrode and further a data bias pulse having a leading edge being synchronized to that of the sustaining charge erasing pulse, the same polarity as that of the sustaining charge erasing pulse and a pulse width being longer than that of the sustaining charge erasing pulse is applied to the data electrode to cause opposing discharge to occur as erasing discharge between the scanning electrode and the data electrode in response to a leading edge of the sustaining erasing and the bias pulse and to cause surface discharge to occur as erasing discharge between the scanning electrode and the sustaining electrode in response to the trailing edge of the bias pulse and to cause opposing discharge to occur as erasing discharge between the scanning electrode and the data electrode in response to the trailing edge of the sustaining charge erasing pulse.

Figure 8:
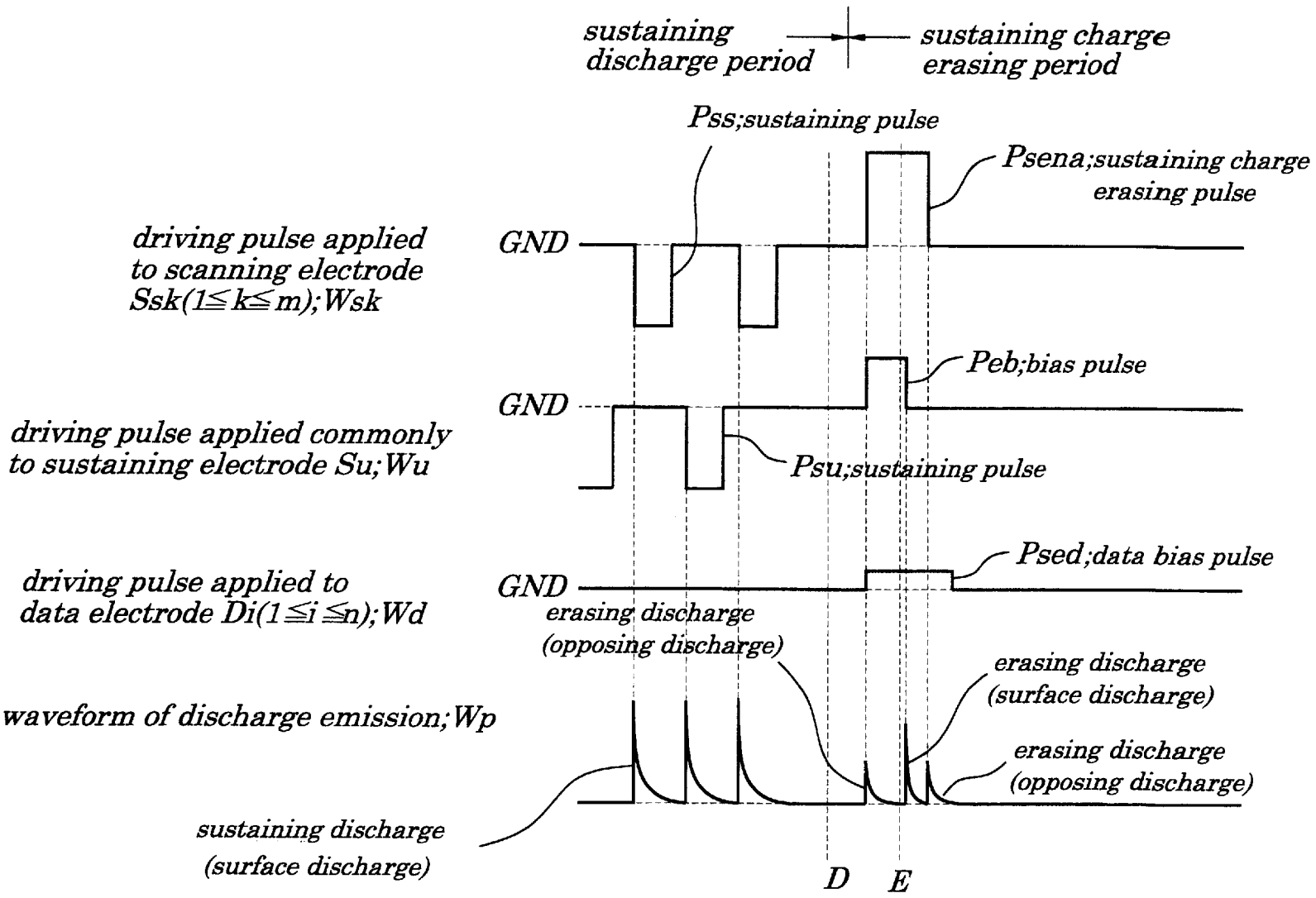
FIG. 8 is an expanded diagram showing waveforms of driving pulses and waveforms of discharge emission at a final stage of the sustaining discharge period and during the sustaining charge erasing period according to a sixth embodiment.

Detailed operations and method of an AC discharge memory-type plasma display panel according to a sixth embodiment of the present invention are hereafter described by referring to FIG. 8. FIG. 8 is an expanded diagram showing waveforms of driving pulses and waveforms Wp of discharge emission at a final stage of the sustaining discharge period and during the sustaining charge erasing period according to a sixth embodiment. In the sixth embodiment, as in the fifth embodiment, the effect is obtained more when the opposing discharge starting voltage is low.

According to the sixth embodiment, as shown in FIG. 8, a data bias pulse Psed is adapted to rise in synchronization with the leading edge of a sustaining charge erasing pulse Psena applied to the scanning electrode and a bias pulse Peb applied to the sustaining electrode and, after the sustaining charge erasing pulse Psena falls, the data bias pulse Psed applied to the data electrode is adapted to fall. The sustaining charge erasing pulse Psena and the bias pulse Ped shown in the sixth embodiment correspond respectively to the sustaining charge erasing pulse Psena and the bias pulse Peb in the first embodiment.

When the sustaining charge erasing pulse Psena, bias pulse Peb and data bias pulse are applied in synchronization, wall charges at a point of the timing D, on the scanning electrode, are superposed on the sustaining charge erasing pulse Psena and act so as to raise the effective voltage having the positive potential and, on the sustaining electrode, act so as to counteract the bias pulse Peb and to cause the effective voltage having the positive potential to be lowered and, on the data electrode, act so as to counteract the data bias pulse Psed of the positive polarity to cause the effective voltage to be at a negative potential.

For example, if the surface discharge starting voltage is 200 V, the opposing discharge starting voltage is 170V, the voltage of the wall charge at a point of the timing D is +30 V on the scanning electrode, −30 V on the sustaining electrode and −60 V on the data electrode, and if a voltage of the front-step portion of the sustaining charge erasing pulse Psend is 170 V, a voltage of the data bias pulse Peb is 80 V and a voltage of the data bias pulse Psed is 70 V, the effective voltage supplied to each electrode is given by the following formula:

Effective voltage between scanning electrode and data electrode= (170V+30V)−[70V+(−60V)]=190V (>170V)

Effective voltage between scanning electrode and sustaining electrode=(170V+30V)−[80V+(−30V)]=150 V (<200V)

Effective voltage between sustaining electrode and data electrode= [80V+(−30V)−[70V+(−60V)]=40 V (<170V)

Since the effective voltage among electrodes is thus applied, discharge occurs between the scanning and data electrodes and discharge is suppressed between the scanning and sustaining electrodes and between the sustaining and data electrodes. In the above calculation, if the data bias pulse Psed is not applied, the effective voltage between the scanning and data electrodes becomes 260V. However, this voltage is very large compared with that of the opposing discharge starting voltage and, even if the data electrode acts as a cathode, a strong discharge occurs, thus causing positive charge to still stay on the data electrode. Therefore, by applying the data bias pulse Psed, the opposing discharge can be reduced.

Next, if the bias pulse Peb is cleared, as in the first embodiment, discharge occurs only between the scanning and sustaining electrodes. Separation of the opposing discharge from the surface discharge during the sustaining charge erasing discharge can be achieved.

Moreover, even if the opposing discharge starting voltage is further lower and positive charges produced by opposing discharge by the application of the data bias pulse Psed, since the data bias pulse Psed continues to be applied in the fall of the sustaining charge erasing pulse Psena, potential relations after the fall of the sustaining charge erasing pulse Psena are reversed and since a voltage is applied so that the data electrode acts as an anode and the scanning electrode acts as an scanning cathode, this voltage is superposed on internal voltage produced by wall charges and, as shown in FIG. 8, opposing discharge as erasing discharge occurs again. Because of this, positive charge which is rendered excessive due to the previous opposing discharge, on the data electrode, can be erased.

Moreover, the sustaining charge erasing pulse Psena and the data bias pulse Psed, if wall charges on the data electrode can be fully erased by using the opposing discharge occurring immediately after their application, may be allowed to fall simultaneously.

Seventh Embodiment

According to a seventh embodiment, during a sustaining erasing period, a first sustaining charge erasing pulse is applied to a scanning electrode, a bias pulse having a leading edge being synchronized to that of the first sustaining charge erasing pulse, the same polarity as that of the first sustaining charge erasing pulse and having the same pulse width as that of the first sustaining charge erasing pulse is applied to the sustaining electrode to cause opposing discharge to occur as erasing discharge between the scanning electrode and the data electrode and a pulse having polarity being opposite to the bias pulse is applied to the sustaining electrode simultaniously and a pulse having the same polarity as that of the first sustaining charge erasing pulse is applied to the scanning electrode to cause surface discharge to occur as erasing discharge between the scanning electrode and the data electrode.

Figure 9:
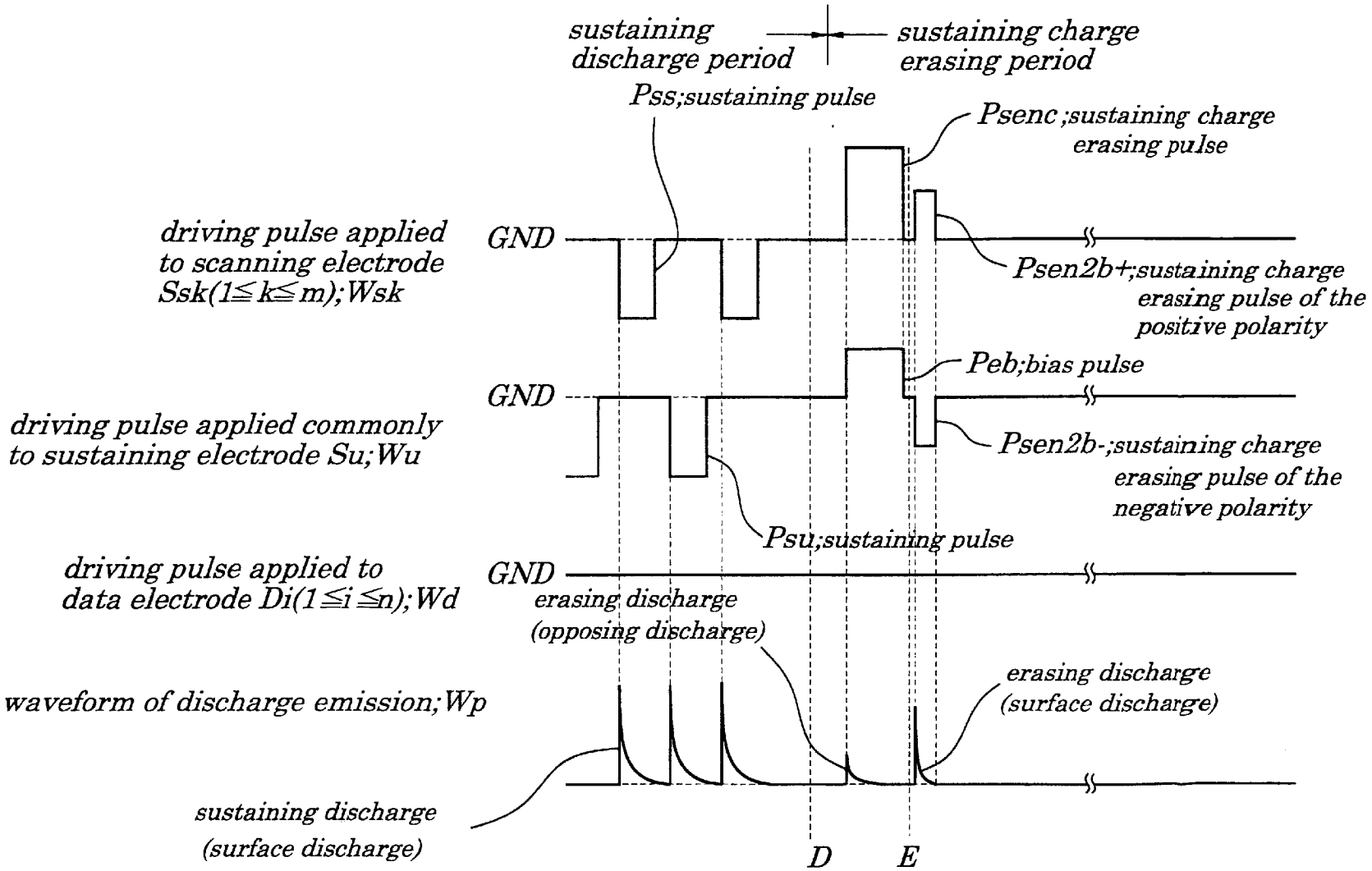
FIG. 9 is an expanded diagram showing waveforms of driving pulses and waveforms of discharge emission at a final stage of the sustaining discharge period and during the sustaining charge erasing period according to a seventh embodiment of the present invention.

Detailed operations and method of an AC discharge memory-type plasma display panel according to a seventh embodiment of the present invention are hereafter described by referring to FIG. 9. FIG. 9 is an expanded diagram showing waveforms of driving pulses and waveforms Wp of discharge emission at a final stage of the sustaining discharge period and during the sustaining charge erasing period according to the seventh embodiment of the present invention.

According to the seventh embodiment, as shown in FIG. 9, as in the second and third embodiments, only the opposing discharge by using the sustaining charge erasing pulse Psenc is allowed to occur and the surface discharge is allowed to occur by using another pulse made bipolar by applying a pulse of the positive polarity to the scanning electrode and a pulse of the negative polarity to the sustaining electrode.

As depicted in FIG. 9, a sustaining charge erasing pulse Psenc (first sustaining charge erasing pulse) is applied to the scanning electrode and a bias pulse Peb having a rise (leading edge) and a fall (trailing edge) each being synchronization with a rise (leading edge) and a fall (trailing edge) of the sustaining charge erasing pulse Psenc is applied. Then, a sustaining charge erasing pulse of the negative polarity Psen2*b*− (second sustaining charge erasing pulse) is applied to the sustaining electrode and the sustaining charge erasing pulse of the positive polarity Psen2*b*+ (second sustaining charge erasing pulse of the positive polarity) is applied to the scanning electrode.

In the seventh embodiment, as in the second and third embodiments, while the sustaining charge erasing pulse Psenc and the bias pulse Peb are applied, only the opposing discharge between the scanning and data electrodes occurs as erasing discharge, and discharge between the sustaining electrode and data electrodes and between the sustaining and data electrodes is suppressed.

Next, if the sustaining charge erasing pulse of the negative polarity Psen2*b*− is applied to the sustaining electrode and, at the same time, the sustaining charge erasing pulse of the positive polarity Psen2*b*+ is applied to the scanning electrode, a wall electrode at a point of timing E is superposed, on the sustaining electrode having negative charges, on an external potential produced by the sustaining charge erasing pulse Psen2− and the sustaining charge erasing pulse Psen2+, between the scanning and sustaining electrodes, and act so as to increase the effective voltage between the scanning and sustaining electrodes.

For example, if the surface discharge starting voltage of PDP is 200 V, the opposing discharge starting voltage is 200V, the voltage by the wall charge at a point of the timing E is 0 V on the scanning electrode and the data electrode, −30 V on the sustaining electrode and the voltage of the Psen2 is 85 V and the voltage of the Psen2 is −85V, the $$\text{effective voltage between the scanning and sustaining electrodes} = (85V+0V)-[(-85V)+(-30V)]=200V\ (=200V),$$

which reaches the surface discharge starting voltage. On the other hand, since wall charges are erased during the previous opposing discharge on the data and scanning electrodes, the surface discharge occurs only between the scanning and sustaining electrodes as erasing discharge. The pulse width of the Psen2− and of the Psen2+ is set to 0.5 to 2 microseconds so that it is a pulse having a short width.

Accordingly, the temporal separation of the opposing discharge and surface discharge during the sustaining charge erasing discharge can be achieved and the same effects as in the first and second embodiments can be obtained as well. In addition to effects described above, as in the third embodiment, because the amplitude of the sustaining charge erasing pulse of the positive polarity can be made smaller, collision of the positive charge against the data electrode is reduced. Also, because the voltage amplitude of the sustaining charge erasing pulse can be made smaller, the plasma display can be driven using a low-cost power circuit. Moreover, the life of the product can be lengthened and the driving circuit can be configured at a lower cost.

Eighth Embodiment

Figure 10:
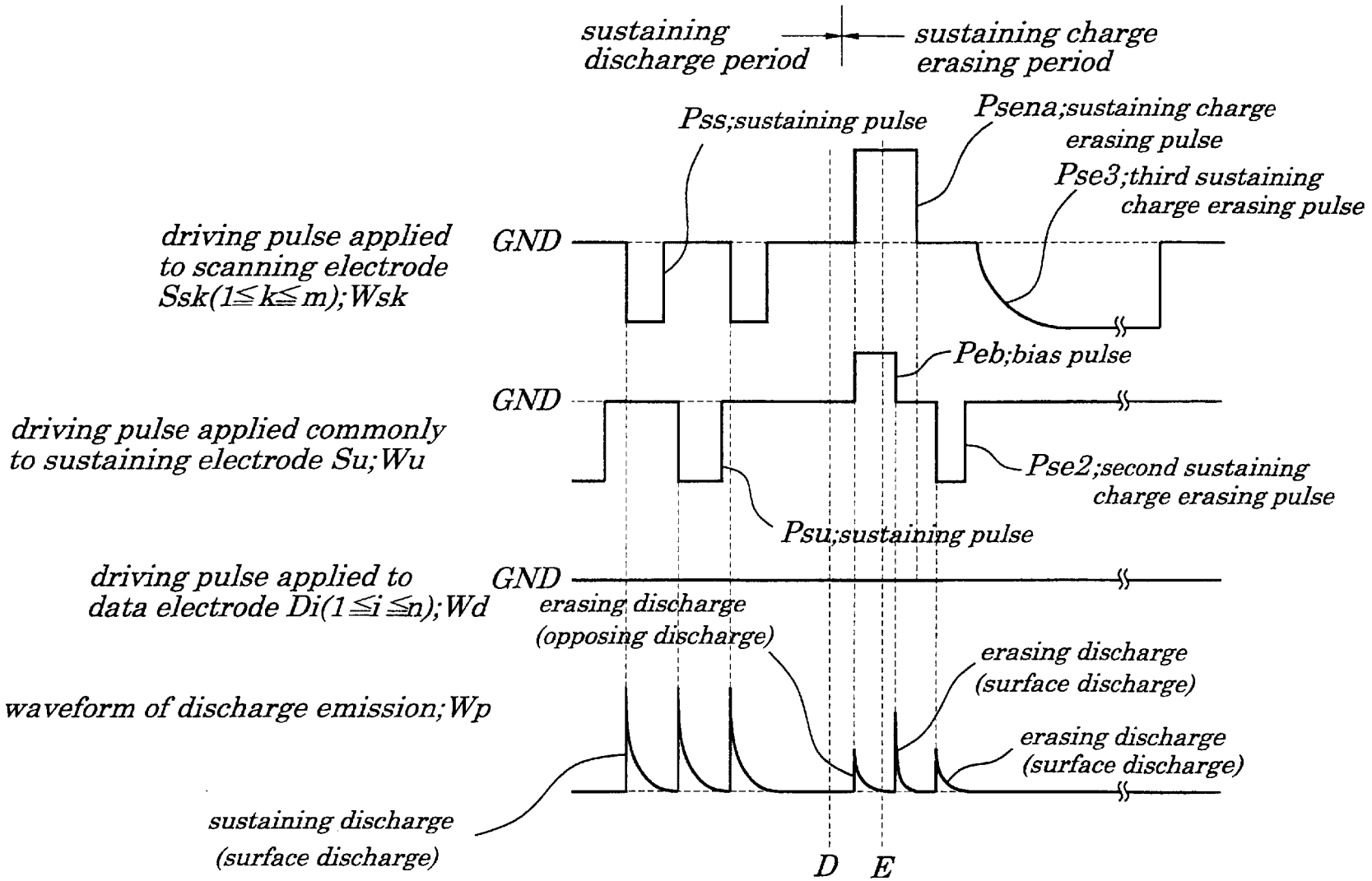
FIG. 10 is an expanded diagram showing waveforms of driving pulses and waveforms of discharge emission at a final stage of the sustaining discharge period and during the sustaining charge erasing period according to an eighth embodiment of the present invention.

Operations and method of an AC discharge memory-type plasma display panel according to an eighth embodiment of the present invention are hereafter described by referring to FIG. 10. FIG. 10 is an expanded diagram showing waveforms of driving pulses and waveforms Wp of discharge emission at a final stage of the sustaining discharge period and during the sustaining charge erasing period according to an eighth embodiment of the present invention.

According to the eighth embodiment, as shown in FIG. 10, a short-width pulse Pse2 (first added sustaining charge erasing pulse) and an erasing pulse Pse3 (second added sustaining charge erasing pulse) having a mildly changing leading edge are added to pulses shown in the first embodiment.

Most of sustaining charge erasing operations are complete by the application of the sustaining charge erasing pulse Psena (first sustaining charge erasing pulse) and the bias pulse Peb. However, if display capacity is large, i.e., the number of cells is large, there is a cell that can not be erased due to variations of driving characteristics of a cell. To accommodate the variations, erasing pulses Pse2 and Pse3 are applied and all cells are erased by the combination of pulses. The first added sustaining charge erasing pulse Pse2 is a pulse having a short width. The second added sustaining charge erasing pulse Pse3 has a large time constant at the time of the fall of the leading edge and its pulse width is sufficiently wide and it has the same amplitude as that of the sustaining pulse. Therefore, though the second added sustaining charge erasing pulse Pse3 does not cause a strong discharge to occur but attracts space charge by electrostatic attractive force of an external voltage and is adapted to re-combine space charges with wall charges stayed in the scanning and sustaining electrodes and to erase the recombined electrodes.

Moreover, in the embodiment, the first added sustaining charge erasing pulse and the second added sustaining charge erasing pulse are added to waveforms of driving of the first embodiment. The same effects can be obtained by adding the first added sustaining charge erasing pulse and the second added sustaining charge erasing pulse to pulses shown in the second to seventh embodiments. Furthermore, in this embodiment, though both of the first added sustaining charge erasing pulse Pse2 and the second added sustaining charge erasing pulse Pse3 are added, if variations in characteristics of a cell are comparatively small, either of them may be added. The first added sustaining charge erasing pulse Pse2 and the second added sustaining charge erasing pulse Pse3 may be applied so that a specified potential is produced. Therefore, the specified voltage for the first added sustaining charge erasing pulse can be provided by applying a pulse of the positive polarity to the scanning electrode and a pulse of the negative polarity to the sustaining electrode or by applying a voltage of the positive polarity only to the scanning electrode. The specified voltage for the second added sustaining charge erasing pulse can be provided by applying a pulse of the negative polarity having a mild fall to the scanning electrode and a pulse of the positive polarity having a mild rise to the sustaining electrode or by applying a pulse of the positive polarity having a mild rise to the sustaining electrode.

Thus, by temporal separation of the opposing discharge from the surface discharge during the sustaining charge erasing discharge, the opposing discharge does not grow to be strong due to no active particles generated by surface discharge and the discharge converges while it is weak. Then, in the subsequent surface discharge, active particles at the time of discharge are small compared with the time when the opposing discharge occurs simultaneouly and the discharge becomes weak. That is, the opposing discharge and surface discharge do not interact with each other and function independently.

Therefore, during the sustaining erasing discharge, as a result of the temporal separation of the opposing discharge from the surface discharge, the opposing discharge and the surface discharge do not interact with each other and the opposing discharge converges while it is weak, and therefore wall charges do not stay. Moreover, since a change of the sustaining discharge caused by display cell does not influence on the opposing discharge, the data electrode is controlled with stability.

As described above, it is difficult that the control of charges on the data electrode is made by the conventional final sustaining pulse of the positive polarity and the erasability of the pulse is insufficient. According to the present invention, charges on the data electrode are erased stably, allowing ensured control of driving.

Also, according to the present invention, the opposing discharge is separated from the surface discharge at the time of sustaining charge erasing time. That is, instead of performing the sustaining discharge using the final sustaining pulse having the polarity opposite to an ordinary sustaining pulse and instead of causing the opposing discharge and surface discharge to occur at the same time, in the sustaining charge discharge, the opposing discharge is first performed and then the surface discharge is performed sequentially, thus making the opposing discharge and surface discharge weakened to reduce charges accumulated on each electrode.

In the above embodiments, the voltage (including ground potential) to be applied is obtained that can satisfy the following relation to cause opposing discharge to occur as erasing discharge between the scanning electrode and the data electrode and to cause surface discharge not to occur between the scanning electrode and the sustaining electrode:

Effective voltage between scanning electrode and data electrode=(Vera+Vscan)−(Vdbais+Vdata)>Vdo Effective voltage between scanning electrode and sustaining electrode=(Vera+Vscan)−(Vdbias+Vsus)<Vds Effective voltage between sustaining electrode and data electrode=(Vsbias+Vsus)−(Vdbais+Vdata)<Vdo where the surface discharge starting voltage is Vds, the opposing discharge starting voltage is Vdo, and where a voltage of each electrode by wall charges immediately before the sustaining erasing period is Vscan on the scanning electrode, Vsus (with positive and negative value opposite to Vscan) on the sustaining electrode and Vdata on the data electrode, and where a voltage of the sustaining charge erasing pulse to be applied to the scanning electrode is Vera, a voltage (including ground potential) of the bias pulse to be applied to the sustaining electrode is Vsbias and a voltage (including ground potential) of the data bias pulse to be applied to the data electrode is Vdbais.

In the above embodiments, by applying, at a time behind the trailing edge of the sustaining charge erasing pulse, the first added sustaining charge erasing pulse having a polarity opposite to the bias pulse to the sustaining electrode, additive opposing discharge can occur as erasing discharge. Moreover, at a time behind the trailing edge of the first added sustaining charge erasing pulse, the second added sustaining charge erasing pulse having polarity being opposite to the sustaining charge erasing pulse and a leading edge being slowly changed may be applied.

Furthermore, in the above embodiments, the sustaining pulse having the same polarity only is applied to the scanning electrode and the sustaining pulse of the opposite polarity is not applied to the scanning electrode. That is, unlike the above-mentioned related art, any final sustaining pulse having polarity being opposite to ordinary sustaining pulse is not applied.

It is apparent that the present invention is not limited to the above embodiments but may be changed and modified without departing from the scope and spirit of the invention.

For example, in the above embodiments, operations are described using a driving sequence in which temporal separation of a writing discharge period from a sustaining discharge period is achieved by putting two or more scanning lines. However, the present invention can be applied to an operation using a driving sequence in which the writing discharge period and sustaining discharge period among different scanning lines are overlapping.

Finally, the present application claims the priority based on Japanese Patent Application No. Hei10-295671 filed on Oct. 16, 1998, which is herein incorporated by reference.

What is claimed is:

1. A method for driving an AC discharge memory-type plasma display panel having a scanning electrode, a sustaining electrode and a data electrode comprising a step of applying a driving pulse to achieve temporal separation of opposing discharge from surface discharge in erasing discharge during a sustaining charge erasing period in driving method containing, at least, a writing period, a sustaining discharge period and a sustaining charge erasing period.

2. The method for driving an AC discharge memory-type plasma display panel according to claim 1, comprising steps of, during a sustaining charge period, applying a sustaining charge erasing pulse to a scanning electrode and applying a bias pulse having a leading edge synchronized to that of said sustaining charge erasing pulse and the same polarity as that of said sustaining charge erasing pulse and pulse width being shorter than that of said sustaining charge erasing pulse to said sustaining electrode to cause opposing discharge to occur as erasing discharge between said scanning electrode and said data electrode in response to a leading edge of said bias pulse and to cause surface discharge to occur as erasing discharge in response to a trailing edge of said bias pulse.

3. The method for driving an AC discharge memory-type plasma display panel according to claim 2, wherein pulse width of said bias pulse is shorter 0.5 to 2 microseconds than that of said sustaining charge erasing pulse.

4. The method for driving an AC discharge memory-type plasma display panel according to claim 1, comprising steps of, during a sustaining charge erasing period, applying a first sustaining charge erasing pulse to said scanning electrode and applying a bias pulse having a leading edge synchronized to that of said first sustaining charge erasing pulse, the same polarity and pulse width as those of said first sustaining charge erasing pulse to said sustaining electrode to cause opposing discharge to occur as erasing discharge between said scanning electrode and said data electrode, and applying a second sustaining charge erasing pulse having the same polarity as that of said first sustaining charge erasing pulse only to said scanning electrode to cause surface discharge to occur as erasing discharge between said scanning electrode and said sustaining electrode.

5. The method for driving an AC discharge memory-type plasma display panel according to claim 4, wherein pulse width of said second sustaining charge erasing pulse is 0.5 to 2 microseconds.

6. The method for driving an AC discharge memory-type plasma display panel according to claim 1, comprising steps of, during a sustaining charge erasing period, applying a first sustaining charge erasing pulse to said scanning electrode and applying a bias pulse having a leading edge synchronized to that of said first sustaining charge erasing pulse and the same polarity and pulse width as those of said first sustaining charge erasing pulse to said sustaining electrode to cause opposing discharge to occur as erasing discharge between said scanning electrode and data electrode, and then applying a second sustaining charge discharge having polarity being opposite to said bias pulse only to said sustaining electrode to cause surface discharge to occur as erasing discharge between said scanning electrode and sustaining electrode.

7. The method for driving an AC discharge memory-type plasma display panel according to claim 6, wherein pulse width of said second sustaining charge erasing pulse is 0.5 to 2 microseconds.

8. The method for driving an AC discharge memory-type plasma display panel according to claim 1, comprising steps of, during a sustaining charge erasing period, applying a sustaining charge erasing pulse comprised of a front-step pulse of a first voltage and a rear-step pulse of said first voltage being higher than that of said front-step pulse to said scanning electrode and applying a data bias pulse having a leading edge synchronized to that of said sustaining charge erasing pulse, polarity being opposite to that of said sustaining charge erasing pulse and the same pulse width as that of said front-step pulse to said data electrode to cause opposing discharge to occur as erasing discharge between said scanning electrode and said data electrode in response to said front-step portion of said sustaining charge erasing pulse and said data bias pulse and to cause surface discharge to occur as erasing discharge between said scanning electrode and said sustaining electrode in response to said rear-step portion of said sustaining charge erasing pulse.

9. The method for driving an AC discharge memory-type plasma display panel according to claim 8, wherein pulse width of the rear-step portion of said sustaining charge erasing pulse is 0.5 to 2 microseconds.

10. The method for driving an AC discharge memory-type plasma display panel according to claim 1, comprising steps of, during a sustaining charge erasing period, applying a sustaining charge erasing pulse to said scanning electrode, applying a bias pulse having a leading edge synchronized to that of said sustaining charge erasing pulse, the same pulse as that of said sustaining charge erasing pulse and pulse width being shorter than that of said sustaining charge erasing pulse to said sustaining electrode to cause opposing discharge to occur as erasing discharge between said scanning electrode and data electrode, and then applying a data bias pulse having a leading edge rising earlier than a trailing edge of said bias pulse, a trailing edge synchronized to that of said sustaining charge erasing pulse and the same polarity as that of said sustaining charge erasing pulse to said data electrode to cause surface discharge to occur as erasing discharge between said scanning electrode and said sustaining electrode in response to the trailing edge of said bias pulse.

11. The method for driving an AC discharge memory-type plasma display panel according to claim 10, wherein a leading edge of said data bias pulse is 0.5 to 2 microseconds slower than that of said sustaining charge erasing pulse.

12. The method for driving an AC discharge memory-type plasma display panel according to claim 1, comprising steps of, during a sustaining charge erasing period, applying a sustaining charge erasing pulse to said scanning electrode, applying a bias pulse having a leading edge synchronized to that of said sustaining charge erasing pulse, the same polarity as that of said sustaining charge erasing pulse and pulse width being shorter than that of said sustaining charge erasing pulse to said sustaining electrode, and then applying a data bias pulse having a leading edge synchronized to that of said sustaining charge erasing pulse, the same polarity as that of said sustaining charge erasing pulse and pulse width being longer than that of said sustaining charge erasing pulse to said data electrode to cause opposing discharge to occur as erasing discharge between said scanning electrode and said data electrode in response to the leading edge of said sustaining charge erasing pulse and said bias pulse and to cause surface discharge to occur as erasing discharge between said scanning electrode and said sustaining electrode in response to the trailing edge of said bias pulse.

13. The method for driving an AC discharge memory-type plasma display panel according to claim 12, wherein pulse width of said data bias pulse is larger than that of said sustaining charge erasing pulse and causes additional opposing discharge to occur as erasing discharge in response to the trailing edge of said sustaining charge erasing pulse.

14. The method for driving an AC discharge memory-type plasma display panel according to claim 1, comprising steps of, during a sustaining charge erasing period, applying a first sustaining charge erasing pulse to said scanning electrode and applying a bias pulse having a leading edge synchronized to that of said first sustaining charge erasing pulse, the same polarity and pulse width as those of said first sustaining charge erasing pulse to said sustaining electrode to cause opposing discharge to occur as erasing discharge between said scanning electrode and said data electrode, and then applying a pulse having polarity being opposite to said bias pulse to said sustaining electrode and a pulse having the same polarity as that of said first sustaining charge erasing pulse to said scanning electrode to cause surface discharge to occur as erasing discharge between said scanning electrode and sustaining electrode.

15. The method for driving an AC discharge memory-type plasma display panel according to any one of claims 1 to 14, comprising steps of applying, at a time behind the trailing edge of said sustaining charge erasing pulse, a voltage as first additional sustaining charge erasing pulse to either of said sustaining electrode used as a cathode and said scanning electrode used as an anode to cause additional surface discharge to occur as erasing discharge.

16. The method for driving an AC discharge memory-type plasma display panel according to any one of claims 1 to 15, comprising steps of applying, at a time behind the trailing edge of said first additional sustaining charge erasing pulse, a voltage showing a slow change as a second additional sustaining charge erasing pulse to either of said sustaining electrode used as an anode and said scanning electrode used as a cathode.

17. The method for driving an AC discharge memory-type plasma display panel according to any one of claims 1 to 16, wherein, during a sustaining discharge period, sustaining pulses having the same polarity only are applied to said scanning electrode and sustaining pulses of the opposite polarity are not applied to said scanning electrode.

* * * * *